US012116871B2

(12) United States Patent
Eitschberger et al.

(10) Patent No.: US 12,116,871 B2
(45) Date of Patent: Oct. 15, 2024

(54) RETRIEVABLE PERFORATING GUN ASSEMBLY AND COMPONENTS

(71) Applicant: DynaEnergetics Europe GmbH, Troisdorf (DE)

(72) Inventors: Christian Eitschberger, Munich (DE); Arash Shahinpour, Troisdorf (DE); Gernot Uwe Burmeister, Austin, TX (US); Thilo Scharf, Letterkenny (IE)

(73) Assignee: DynaEnergetics Europe GmbH, Troisdorf (DE)

( * ) Notice: Subject to any disclaimer, the term of this patent is extended or adjusted under 35 U.S.C. 154(b) by 232 days.

(21) Appl. No.: 17/437,124

(22) PCT Filed: Mar. 24, 2020

(86) PCT No.: PCT/EP2020/058241
§ 371 (c)(1),
(2) Date: Sep. 8, 2021

(87) PCT Pub. No.: WO2020/200935
PCT Pub. Date: Oct. 8, 2020

(65) Prior Publication Data

US 2022/0178230 A1 Jun. 9, 2022

Related U.S. Application Data

(60) Provisional application No. 62/827,468, filed on Apr. 1, 2019.

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
CPC ..... E21B 43/117; E21B 43/1185
See application file for complete search history.

(56) References Cited

U.S. PATENT DOCUMENTS 2,216,359 A 10/1940 Spencer
2,358,466 A 9/1944 Miller
(Continued)

FOREIGN PATENT DOCUMENTS

CA 2821506 A1 1/2015
CA 2824838 A1 2/2015
(Continued)

OTHER PUBLICATIONS

European Patent Office; Rule 161 Communication for EP Application No. 20716372.6; dated Feb. 11, 2022; 3 pages.
(Continued)

*Primary Examiner* — Dany E Akakpo
(74) *Attorney, Agent, or Firm* — Womble Bond Dickinson (US) LLP

(57) ABSTRACT

A perforating gun assembly includes an exposed perforating gun module. The exposed perforating gun module includes a housing having a first connector end, a second connector end opposite and spaced apart from the first connector end, and a chamber extending along a central axis of the housing between the first and second connector ends. The chamber is configured for receiving a detonator and optionally, a radial booster charge coupled to the detonator. A plurality of sockets extends from an outer surface of the housing towards the chamber. Each socket is configured to receive an encapsulated shaped charge. The encapsulated shaped charges may include a protrusion having an external thread that threadingly engage a complimentary threaded portion of the sockets. The detonator may directly initiate the radial booster charge or the encapsulated shaped charges.

16 Claims, 21 Drawing Sheets

(56) References Cited

U.S. PATENT DOCUMENTS 2,418,486 A 4/1947 Smylie
2,462,784 A 2/1949 Smith
2,598,651 A 5/1952 Spencer
2,734,456 A 2/1956 Sweetman
RE24,127 E 3/1956 Binns et al.
2,756,958 A 7/1956 Binns et al.
2,761,384 A 9/1956 Sweetman
2,765,739 A * 10/1956 Mohaupt ..... E21B 43/117 175/4.6
2,785,631 A 3/1957 Blanchard
2,821,136 A 1/1958 Castel
2,889,775 A 6/1959 Owen
2,946,283 A 7/1960 Udry
3,013,491 A 12/1961 Poulter
3,116,690 A 1/1964 Gillingham et al.
3,170,400 A 2/1965 Nelson
3,246,707 A 4/1966 Bell
3,374,735 A 3/1968 Moore
3,444,810 A 5/1969 Hakala
3,504,723 A 4/1970 Cushman et al.
3,859,921 A 1/1975 Stephenson
4,007,790 A 2/1977 Henning
4,007,796 A 2/1977 Boop
4,058,061 A 11/1977 Mansur, Jr. et al.
4,140,188 A 2/1979 Vann
4,182,216 A 1/1980 DeCaro
4,250,960 A 2/1981 Chammas
4,266,613 A 5/1981 Boop
4,269,120 A 5/1981 Brede et al.
4,290,486 A 9/1981 Regalbuto
4,312,273 A 1/1982 Camp
4,491,185 A 1/1985 McClure
4,496,008 A 1/1985 Pottier et al.
4,512,418 A 4/1985 Regalbuto et al.
4,523,650 A 6/1985 Sehnert et al.
4,574,892 A 3/1986 Grigar et al.
4,598,775 A 7/1986 Vann et al.
4,609,057 A 9/1986 Walker et al.
4,619,318 A 10/1986 Terrell et al.
4,621,396 A 11/1986 Walker et al.
4,650,009 A 3/1987 McClure et al.
4,655,138 A 4/1987 Regalbuto et al.
4,657,089 A 4/1987 Stout
4,747,201 A 5/1988 Donovan et al.
4,753,170 A 6/1988 Regalbuto et al.
4,776,393 A 10/1988 Forehand et al.
4,790,383 A 12/1988 Savage et al.
4,800,815 A 1/1989 Appledorn et al.
4,869,171 A 9/1989 Abouav
4,889,183 A 12/1989 Sommers et al.
5,027,708 A 7/1991 Gonzalez et al.
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,322,019 A 6/1994 Hyland
5,392,860 A 2/1995 Ross
5,436,791 A 7/1995 Turano et al.
5,509,480 A 4/1996 Terrell et al.
5,575,331 A 11/1996 Terrell
5,603,384 A 2/1997 Bethel et al.
5,673,760 A 10/1997 Brooks et al.
5,703,319 A 12/1997 Fritz et al.
5,775,426 A 7/1998 Snider et al.
5,785,130 A 7/1998 Wesson et al.
5,816,343 A 10/1998 Markel et al.
5,992,289 A 11/1999 George et al.
6,006,833 A 12/1999 Burleson et al.
6,012,525 A 1/2000 Burleson et al.
6,112,666 A 9/2000 Murray et al.
6,164,375 A 12/2000 Carisella
6,216,596 B1 4/2001 Wesson
6,298,915 B1 10/2001 George
6,305,287 B1 10/2001 Capers et al.
6,354,374 B1 3/2002 Edwards et al.
6,418,853 B1 7/2002 Duguet et al.
6,651,747 B2 11/2003 Chen et al.
6,675,896 B2 1/2004 George
6,739,265 B1 5/2004 Badger et al.
6,742,602 B2 6/2004 Trotechaud
6,752,083 B1 6/2004 Lerche et al.
6,773,312 B2 8/2004 Bauer et al.
6,843,317 B2 1/2005 Mackenzie
7,107,908 B2 9/2006 Forman et al.
7,193,527 B2 3/2007 Hall
7,278,491 B2 10/2007 Scott
7,364,451 B2 4/2008 Ring et al.
7,568,429 B2 8/2009 Hummel et al.
7,762,172 B2 7/2010 Li et al.
7,778,006 B2 8/2010 Stewart et al.
7,810,430 B2 10/2010 Chan et al.
7,901,247 B2 3/2011 Ring
7,908,970 B1 3/2011 Jakaboski et al.
7,929,270 B2 4/2011 Hummel et al.
7,934,453 B2 5/2011 Moore
7,952,035 B2 5/2011 Falk et al.
7,980,874 B2 7/2011 Finke et al.
8,066,083 B2 11/2011 Hales et al.
8,069,789 B2 12/2011 Hummel et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,230,788 B2 7/2012 Brooks et al.
8,256,337 B2 9/2012 Hill
8,395,878 B2 3/2013 Stewart et al.
8,443,886 B2 5/2013 Torres et al.
8,451,137 B2 5/2013 Bonavides et al.
8,561,683 B2 10/2013 Wood et al.
8,661,978 B2 3/2014 Backhus et al.
8,684,083 B2 4/2014 Torres et al.
8,695,506 B2 4/2014 Lanclos
8,863,665 B2 10/2014 DeVries et al.
8,875,787 B2 11/2014 Tassaroli
8,881,816 B2 11/2014 Glenn et al.
9,038,521 B1 5/2015 Rollins et al.
9,080,433 B2 7/2015 Lanclos et al.
9,181,790 B2 11/2015 Mace et al.
9,194,219 B1 11/2015 Hardesty et al.
9,270,051 B1 2/2016 Christiansen et al.
9,284,819 B2 3/2016 Tolman et al.
9,428,979 B2 8/2016 Bell et al.
9,466,916 B2 10/2016 Li et al.
9,476,289 B2 10/2016 Wells
9,494,021 B2 11/2016 Parks et al.
9,523,255 B2 12/2016 Andrzejak
9,562,421 B2 2/2017 Hardesty et al.
9,574,416 B2 2/2017 Wright et al.
9,581,422 B2 2/2017 Preiss et al.
9,598,942 B2 3/2017 Wells et al.
9,605,937 B2 3/2017 Eitschberger et al.
9,677,363 B2 6/2017 Schacherer et al.
9,709,373 B2 7/2017 Hikone et al.
9,784,549 B2 10/2017 Eitschberger
9,903,192 B2 2/2018 Entchev et al.
10,000,994 B1 6/2018 Sites
10,060,234 B2 8/2018 Robey et al.
10,066,921 B2 9/2018 Eitschberger
10,077,641 B2 9/2018 Rogman et al.
10,138,713 B2 11/2018 Tolman et al.
10,151,180 B2 12/2018 Robey et al.
10,188,990 B2 1/2019 Burmeister et al.
10,190,398 B2 1/2019 Goodman et al.
10,273,788 B2 4/2019 Bradley et al.
10,352,136 B2 7/2019 Goyeneche
10,400,558 B1 9/2019 Shahinpour et al.
10,458,213 B1 10/2019 Eitschberger et al.
10,641,068 B2 5/2020 Hardesty et al.
10,844,696 B2 11/2020 Eitschberger et al.
10,920,543 B2 2/2021 Eitschberger
D984,881 S 5/2023 Arndt
D987,778 S 5/2023 Baeten

(56) References Cited

U.S. PATENT DOCUMENTS

| | | | |
|---|---|---|---|
| D988,471 | S | 6/2023 | Stein |
| D989,915 | S | 6/2023 | Pelletier |
| D992,699 | S | 7/2023 | Ertur |
| D993,365 | S | 7/2023 | Chandler |
| D1,001,977 | S | 10/2023 | Viens |
| D1,006,088 | S | 11/2023 | Kim |
| 2002/0020320 | A1 | 2/2002 | Lebaudy et al. |
| 2002/0062991 | A1 | 5/2002 | Farrant et al. |
| 2002/0129940 | A1 | 9/2002 | Yang et al. |
| 2003/0000411 | A1 | 1/2003 | Cernocky et al. |
| 2003/0001753 | A1 | 1/2003 | Cernocky et al. |
| 2005/0178282 | A1 | 8/2005 | Brooks et al. |
| 2005/0186823 | A1 | 8/2005 | Ring et al. |
| 2005/0194146 | A1 | 9/2005 | Barker et al. |
| 2005/0229805 | A1 | 10/2005 | Myers, Jr. et al. |
| 2007/0084336 | A1 | 4/2007 | Neves |
| 2007/0125540 | A1 | 6/2007 | Gerez et al. |
| 2007/0158071 | A1 | 7/2007 | Mooney, Jr. et al. |
| 2008/0047456 | A1 | 2/2008 | Li et al. |
| 2008/0110612 | A1 | 5/2008 | Prinz et al. |
| 2008/0134922 | A1 | 6/2008 | Grattan et al. |
| 2008/0149338 | A1 | 6/2008 | Goodman et al. |
| 2008/0173204 | A1 | 7/2008 | Anderson et al. |
| 2008/0264639 | A1 | 10/2008 | Parrott et al. |
| 2009/0050322 | A1 | 2/2009 | Hill et al. |
| 2009/0272529 | A1 | 11/2009 | Crawford |
| 2010/0000789 | A1 | 1/2010 | Barton et al. |
| 2010/0089643 | A1 | 4/2010 | Vidal |
| 2010/0163224 | A1 | 7/2010 | Strickland |
| 2010/0230104 | A1 | 9/2010 | Nölke et al. |
| 2011/0024116 | A1 | 2/2011 | McCann et al. |
| 2012/0085538 | A1 | 4/2012 | Guerrero et al. |
| 2012/0160491 | A1 | 6/2012 | Goodman et al. |
| 2012/0199031 | A1 | 8/2012 | Lanclos |
| 2012/0199352 | A1 | 8/2012 | Lanclos et al. |
| 2012/0241169 | A1 | 9/2012 | Hales et al. |
| 2012/0242135 | A1 | 9/2012 | Thomson et al. |
| 2012/0247769 | A1 | 10/2012 | Schacherer et al. |
| 2012/0247771 | A1 | 10/2012 | Black et al. |
| 2012/0298361 | A1 | 11/2012 | Sampson |
| 2013/0008639 | A1 | 1/2013 | Tassaroli et al. |
| 2013/0062055 | A1 | 3/2013 | Tolman et al. |
| 2013/0118342 | A1 | 5/2013 | Tassaroli |
| 2013/0126237 | A1 | 5/2013 | Burton et al. |
| 2013/0199843 | A1 | 8/2013 | Ross |
| 2013/0248174 | A1 | 9/2013 | Dale et al. |
| 2014/0131035 | A1 | 5/2014 | Entchev et al. |
| 2015/0176386 | A1 | 6/2015 | Castillo et al. |
| 2015/0226044 | A1 | 8/2015 | Ursi et al. |
| 2015/0330192 | A1 | 11/2015 | Rogman et al. |
| 2015/0376991 | A1 | 12/2015 | Mcnelis et al. |
| 2016/0040520 | A1 | 2/2016 | Tolman et al. |
| 2016/0061572 | A1 | 3/2016 | Eitschberger et al. |
| 2016/0069163 | A1 | 3/2016 | Tolman et al. |
| 2016/0168961 | A1 | 6/2016 | Parks et al. |
| 2016/0356132 | A1* | 12/2016 | Burmeister ..... E21B 43/119 |
| 2017/0030693 | A1 | 2/2017 | Preiss et al. |
| 2017/0058649 | A1 | 3/2017 | Geerts et al. |
| 2017/0145798 | A1 | 5/2017 | Robey et al. |
| 2017/0167233 | A1 | 6/2017 | Sampson et al. |
| 2017/0211363 | A1 | 7/2017 | Bradley et al. |
| 2017/0241244 | A1 | 8/2017 | Barker et al. |
| 2017/0268860 | A1 | 9/2017 | Eitschberger |
| 2017/0275976 | A1* | 9/2017 | Collins ..... E21B 43/117 |
| 2017/0314372 | A1 | 11/2017 | Tolman et al. |
| 2017/0335646 | A1 | 11/2017 | Huang et al. |
| 2018/0030334 | A1 | 2/2018 | Collier et al. |
| 2018/0038208 | A1 | 2/2018 | Eitschberger et al. |
| 2018/0135398 | A1 | 5/2018 | Entchev et al. |
| 2018/0209250 | A1 | 7/2018 | Daly et al. |
| 2018/0209251 | A1 | 7/2018 | Robey et al. |
| 2018/0231361 | A1 | 8/2018 | Wicks et al. |
| 2018/0274342 | A1 | 9/2018 | Sites |
| 2018/0299239 | A1 | 10/2018 | Fitschberger et al. |
| 2018/0318770 | A1 | 11/2018 | Eitschberger et al. |
| 2018/0347324 | A1 | 12/2018 | Langford et al. |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0186241 | A1 | 6/2019 | Yang et al. |
| 2019/0195054 | A1 | 6/2019 | Bradley et al. |
| 2019/0211655 | A1 | 7/2019 | Bradley et al. |
| 2019/0284889 | A1 | 9/2019 | LaGrange et al. |
| 2019/0292886 | A1 | 9/2019 | Shahinpour et al. |
| 2019/0292887 | A1 | 9/2019 | Austin, II et al. |
| 2019/0316449 | A1 | 10/2019 | Schultz et al. |
| 2020/0063537 | A1 | 2/2020 | Langford et al. |
| 2020/0199957 | A1* | 6/2020 | Bertoja ..... E21B 23/00 |
| 2020/0217635 | A1 | 7/2020 | Eitschberger |
| 2020/0392821 | A1 | 12/2020 | Fitschberger et al. |
| 2021/0340844 | A1 | 11/2021 | Eitschberger et al. |
| 2023/0184066 | A1 | 6/2023 | Hoelscher |
| 2023/0304384 | A1 | 9/2023 | Rajaram |
| 2023/0366299 | A1 | 11/2023 | Badll |

FOREIGN PATENT DOCUMENTS

| | | | |
|---|---|---|---|
| CA | 3101558 | A1 | 12/2019 |
| CN | 85107897 | A | 9/1986 |
| CN | 101397890 | A | 4/2009 |
| CN | 201607180 | U | 10/2010 |
| CN | 101892822 | B | 11/2010 |
| CN | 201620848 | U | 11/2010 |
| CN | 102305058 | A | 1/2012 |
| CN | 105492721 | A | 4/2016 |
| EP | 0088516 | A1 | 9/1983 |
| GB | 2065750 | B | 6/1983 |
| GB | 2533822 | A | 7/2016 |
| GB | 2522413 | B | 4/2017 |
| RU | 2633904 | C1 | 10/2017 |
| WO | 0159401 | A1 | 8/2001 |
| WO | 2001059401 | A1 | 8/2001 |
| WO | 2009091422 | A2 | 7/2009 |
| WO | 2012006357 | A2 | 1/2012 |
| WO | 2015006869 | A1 | 1/2015 |
| WO | 2015134719 | A1 | 9/2015 |
| WO | 2018009223 | A1 | 1/2018 |
| WO | 2018057949 | A1 | 3/2018 |
| WO | 2019148009 | A2 | 8/2019 |

OTHER PUBLICATIONS

China National Intellectual Property Administration; Office Action for CN Application No. 202080027454.1; dated Mar. 27, 2023; 14 pages.

United States Patent and Trademark Office; Non-Final Office Action for U.S. Appl. No. 17/588,830; dated Mar. 27, 2023; 13 pages.

International Searching Authority; International Preliminary Report on Patentability of the International Searching Authority for PCT/EP2021/057570; mailed on Oct. 6, 2022; 14 pages.

United States Patent and Trademark Office; Notice of Allowance for U.S. Appl. No. 29/758,155; dated Nov. 21, 2022; 8 pages.

Amit Govil, Selective Perforation: A Game Changer in Perforating Technology—Case Study, presented at the 2012 European and West African Perforating Symposium, Schlumberger, Nov. 7-9. 2012, 14 pgs.

Austin Powder Company; A—140 F & Block, Detonator & Block Assembly; Jan. 5, 2017; 2 pgs.; https://www.austinpowder.com/wp-content/uploads/2019/01/OilStar_A140Fbk-2.pdf.

Baker Hughes, Long Gun Deployment Systems IPS-12-28; 2012 International Perforating Symposium; Apr. 26-27, 2011; 11 pages.

Baker Hughes; SurePerf Rapid Select-Fire System Perforate production zones in a single run; 2012; 2 pages.

Dynaenergetics, DYNAselect Electronic Detonator 0015 SFDE RDX 1.4B, Product Information, Dec. 16, 2011, 1 pg.

Dynaenergetics, DYNAselect Electronic Detonator 0015 SFDE RDX 1.4S, Product Information, Dec. 16, 2011, 1 pg.

Dynaenergetics, DYNAselect System, information downloaded from website, Jul. 3, 2013, 2 pages, http://www.dynaenergetics.com/.

Dynaenergetics, Electronic Top Fire Detonator, Product Information Sheet, Jul. 30, 2013, 1 pg.

(56) References Cited

OTHER PUBLICATIONS

Dynaenergetics, Gun Assembly, Product Summary Sheet, May 7, 2004, 1 page.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Eric H. Findlay, Jury Trial Demand in Civil Action No. 6:20-cv-00069-ADA, dated Apr. 22, 2020, 32 pages.
Gilliat et al.; New Select-Fire System: Improved Reliability and Safety in Select Fire Operations; 2012; 16 pgs.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Titan Inc.; Petition for Post Grant Review of U.S. Pat. No. 10,429, 161; dated Jun. 30, 2020; 109 pages.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Jet Research Center Inc., Jrc Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Owen Oil Tools & Pacific Scientific; RF-Safe Green Det, Side Block for Side Initiation, Jul. 26, 2017, 2 pgs.
Owen Oil Tools, Recommended Practice for Oilfield Explosive Safety, Presented at 2011 MENAPS Middle East and North Africa Perforating Symposium, Nov. 28-30, 2011, 6 pages.
Schlumberger & Said Abubakr, Combining and Customizing Technologies for Perforating Horizontal Wells in Algeria, Presented at 2011 MENAPS, Nov. 28-30, 2011, 20 pages.
Smylie, Tom, New Safe and Secure Detonators for the Industry's consideration, presented at Explosives Safety & Security Conference, Marathon Oil Co, Houston; Feb. 23-24, 2005, 20 pages.
U.S. Patent Trial and Appeal Board, Institution of Inter Partes Review of U.S. Pat. No. 9,581,422, Case IPR2018-00600, Aug. 21, 2018, 9 pages.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trial Appeal Board; Final Written Decision on IPR2018-00600; issued Aug. 20, 2019; 31 pages.
Inpi Argentina; Office Action issued in Argentina Application No. 20200100902 dated Nov. 11, 2023; 4 pages.
U.S. Patent and Trademark Office; Notice of Allowance issued in Design U.S. Appl. No. 29/758,075, filed Dec. 13, 2023; 8 pages.
Dynaenergetics Europe Gmbh; Exposed Gun Subs & Accessories; dated May 23, 2017; https://www.dynaenergetics.com/products/hardware-and-tcp/perforating-gun-systems/exposed-gun-subs-accessories.
Harrison Jet Gun Xtra Penetrator, website visited Nov. 29. 2018, 1 pg., https://www.google.com/search?q=harrison+jet+gun+xtra+penetrator&client=firefox-b-1-d&source=Inms&tbm=isch&sa=X&ved=0ahUKEwjY0KOQ1YTjAhXHmeAKHa00DeYQ_AUIESgC&biw=1440&bih=721#imgrc=ZlqpUcJ_-TL3IM.
Harrison Jet Guns; Image of "xtra penetrator".
International Searching Authority, International Search and Written Opinion of International App. No. PCT/EP2020/058241, dated Aug. 10, 2020, 18 pgs.
International Searching Authority; International Preliminary Report on Patentability of the International Searching Authority for PCT/EP2020/058241; mailed on Oct. 14, 2021; 14 pages.
International Searching Authority; International Search Report and Written Opinion of the International Searching Authority for PCT/EP2021/057570; mailed on Sep. 13, 2021; 21 pages.
International Searching Authority; International Searching Authority Partial Search Report and Invitation to Pay Additional Search Fees for PCT/EP2021/057570; mailed on Jul. 22, 2021; 17 pages.
European Patent Office; Office Action issued in European Application No. 20716372.6 dated Jan. 30, 2024; 15 pages.

* cited by examiner

RETRIEVABLE PERFORATING GUN ASSEMBLY AND COMPONENTS

CROSS-REFERENCE TO RELATED APPLICATIONS

This application is application is a national stage application of and claims priority to Patent Cooperation Treaty (PCT) Application No. PCT/EP2020/058241 filed Mar. 24, 2020, which claims the benefit of U.S. Provisional Patent Application No. 62/827,468 filed Apr. 1, 2019, which is incorporated herein by reference in its entirety.

BACKGROUND OF THE DISCLOSURE

Hydrocarbons, such as fossil fuels (e.g. oil) and natural gas, are extracted from underground wellbores extending deeply below the surface using complex machinery and explosive devices. Once the wellbore is established by placement of casing pipes after drilling, a perforating gun assembly, or train or string of multiple perforating gun assemblies, are lowered into the wellbore, and positioned adjacent one or more hydrocarbon reservoirs in underground formations.

Assembly of a perforating gun requires assembly of multiple parts. Such parts typically include a housing or outer gun barrel. An electrical wire for communicating from the surface to initiate ignition, a percussion initiator and/or a detonator, a detonating cord, one or more charges which are held in an inner tube, strip or carrying device and, where necessary, one or more boosters are typically positioned in the housing. Assembly of the perforating gun typically includes threaded insertion of one component into another by screwing or twisting the components into place. Tandem seal adapters/subs are typically used in conjunction with perforating gun assemblies to connect multiple perforating guns together. The tandem seal adapters are typically configured to provide a seal and mechanical connection between adjacent perforating guns. Some tandem seal adapters may be provided internally or externally between adjacent perforating guns, which, in addition to requiring the use of multiple parts or connections between the perforating guns, may increase the length of each perforating gun and may be more expensive to manufacture. One such system is described in PCT Publication No. WO 2015/179787A1 assigned to Hunting Titan Inc.

The perforating gun includes explosive charges, typically shaped, hollow or projectile charges, which are initiated to perforate holes in the casing and to blast through the formation so that the hydrocarbons can flow through the casing. The explosive charges may be arranged in a hollow charge carrier or other holding devices. Typically, the charges are arranged in different phases, such as 60°, 120°, 180°, and any other desired phasing. Once the perforating gun(s) is properly positioned, a surface signal actuates an ignition of a fuse or detonator, which in turn initiates a detonating cord, which detonates the explosive charges to penetrate/perforate the casing and thereby allow formation fluids to flow through the perforations formed and into a production string. Upon detonation of the explosive charges, it is often desirable to retrieve the carrier, associated hardware and any undetonated shaped charges from the casing/wellbore, which may result in obstructions in the wellbore. Perforating gun assemblies may be modified with additional components, end plates, internal sleeves, and the like in an attempt to capture such debris. U.S. Pat. No. 7,441,601 to GeoDynamics Inc., for example, describes a perforating gun assembly having an inner sleeve configured with pre-drilled holes that shifts in relation to an outer gun barrel upon detonation of the explosive charges in the perforating gun, to close the holes formed by the explosive charges. Such perforating gun assemblies require numerous components, may be costly to manufacture and assemble, and may reduce/limit the size of the explosive charges, in relation to the gun diameter, which may be compatible with the gun assembly.

There is a need for an improved perforating gun assembly that can be directly connected to an adjacent perforating gun assembly without the use of tandem seal adapters or tandem subs to facilitate a sealed connection between the perforating gun assemblies. There is a further need for a perforating gun assembly that can be retrieved from the wellbore prior to or after detonation of a plurality of shaped charges, while also minimizing debris that remains in the wellbore.

BRIEF DESCRIPTION OF THE EXEMPLARY EMBODIMENTS

Embodiments of the disclosure are associated with a perforating gun assembly including an exposed perforating gun module. The perforating gun module includes a housing having a first connector end, a second connector end opposite and spaced apart from the first connector end, and a chamber extending along a central axis of the housing between the first and second connector ends. The chamber is configured for receiving an initiator, such as a detonator and an igniter, and optionally, at least one of a radial booster charge, a detonating cord and a bi-directional booster. A plurality of sockets extend into an outer surface of the housing towards the chamber. The sockets are arranged about the central axis of the housing. The sockets may be arranged radially about the central axis. It is contemplated that the sockets may be arranged inline, such that each socket extends in a direction that is parallel to the central axis of the housing. Alternatively, the sockets may be arranged in a spiral configuration around the central axis. Each socket is configured dimensionally for receiving and securing a shaped charge therein. The shaped charge may be secured therein by any securing mechanism, such as, for example, a threaded connection between the socket and each shaped charge. According to an aspect, each shaped charge may be encapsulated or individually pressure sealed.

Embodiments of the disclosure are further associated with a perforating gun assembly including an exposed perforating gun module and a plurality of shaped charges or encapsulated shaped charges secured to the perforating gun module. The perforating gun module may be configured substantially described hereinabove, including a housing having a first connector end and a second connector end that is opposite and spaced apart from the first connector end. A chamber extends along a central axis of the housing between the first and second connector ends. A plurality of sockets are formed in an outer surface of the housing, each socket being arranged radially about the central axis of the housing, inline such that the sockets are in a line that is parallel to the central axis, or in a spiral configuration around the central axis of the housing. Each socket includes a plurality of internal threads and is in open communication with the chamber. A plurality of shaped charges are secured to the sockets in an outward, radial or inline arrangement. Each shaped charge may include a back wall protrusion having a plurality of external threads that are threadingly connected to the internal threads of the socket. According to an aspect, a wireless, push-in detonator is positioned within the chamber of the housing. The detonator includes a detonator head and a detonator shell. The detonator shell is adjacent the back wall protrusion of each shaped charge, such that the detonator directly initiates the shaped charges. Each shaped charge may be individually pressure sealed (i.e., encapsulated).

The present disclosure is further associated with an encapsulated shaped charge. The shaped charge includes a case, a closed end, an open end opposite the closed end, and a side wall extending between the closed end and the open end. The case, the closed end, the open end and the side walls together form a cavity. The shaped charge further includes an explosive load disposed or otherwise arranged in the cavity and a liner adjacent the explosive load. A closure member operatively closes the open end, so that the shaped charges are individually pressure sealed and the liner and explosive load are not exposed to wellbore pressure and wellbore fluids. In an embodiment, shaped charge includes a back wall protrusion adjacent the closed end. According to an aspect, the protrusion includes a plurality of external threads configured to threadingly engage a complimentary threaded portion of a perforating gun housing.

Further embodiments are associated with a wireless, push-in detonator or igniter. The detonator may be particularly useful for use with a perforating gun assembly. The detonator may be configured to directly initiate a shaped charge in response to a digital initiating code. The detonator includes a detonator head and a detonator shell. The detonator head includes a line-in portion, a ground portion, and an insulator. According to an aspect, the insulator extends between the line-in portion and the ground portion. The detonator shell may be adjacent the ground portion. According to an aspect, the detonator shell includes a lineout portion. An electronic circuit board is housed within the detonator shell, adjacent the detonator head. The electronic circuit board is configured for receiving an ignition signal, such as the digital initiating code. The shaped charge directly initiated by the detonator may be a radial booster charge adjacent the closed end portion. When the radial booster charge is directly initiated by the detonator, it may produce a radial explosive force.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
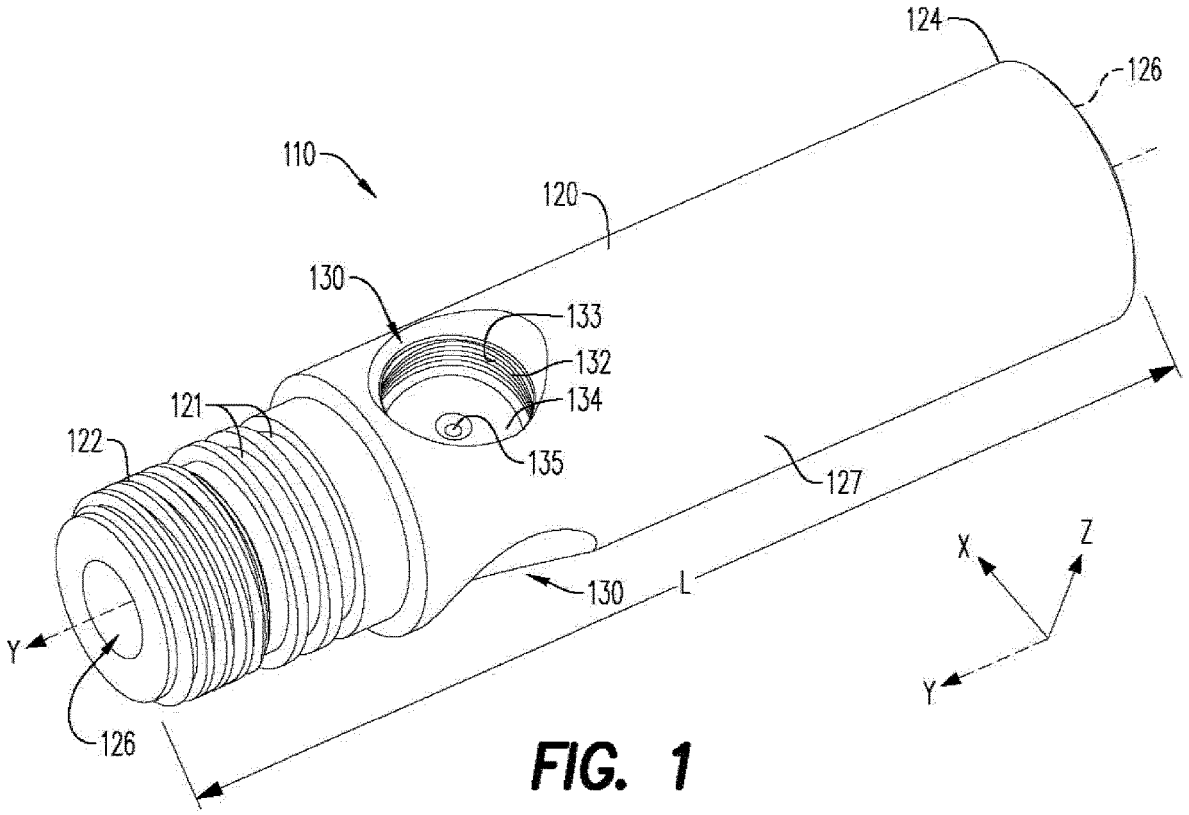
FIG. 1 is a perspective view of a housing of an exposed perforating gun module.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

For purposes of illustrating features of the embodiments, examples will now be introduced and referenced throughout the disclosure. Those skilled in the art will recognize that these examples are illustrative and not limiting and are provided purely for explanatory purposes.

Figure 2A:
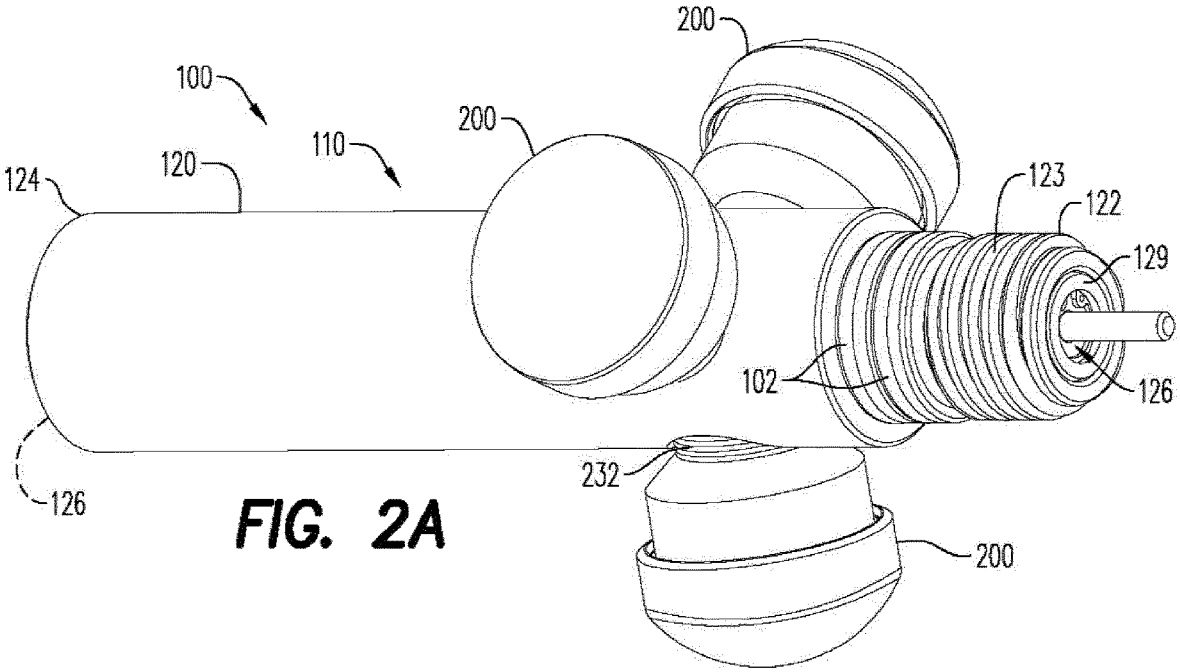
FIG. 2A is a side, perspective view of an exposed perforating gun module including a plurality of encapsulated shaped charges.
Figure 2B:
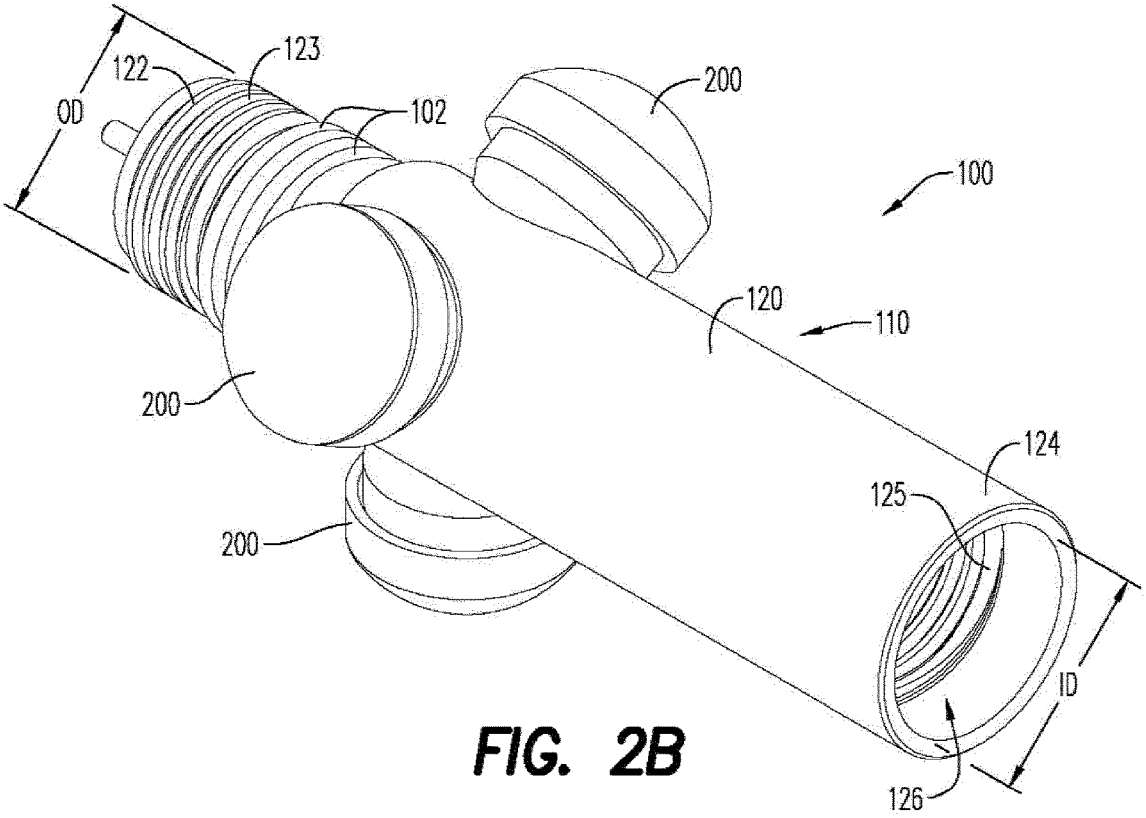
FIG. 2B is a perspective view of the perforating gun module of FIG. 2A.

As illustrated in FIG. 1 and FIGS. 2A-2B, embodiments of the disclosure are associated with a perforating gun module/an exposed perforating gun module 110 that is capable of being directly coupled to additional perforating gun modules (including additional exposed perforating modules). While it is contemplated that a tandem seal adapter or tandem sub assembly may be disposed between or be used to couple adjacent perforating gun modules to each other, such tandem seal adapters or tandem sub assemblies are not necessarily required. The perforating gun module 110 is configured for receiving shaped charges, such as encapsulated shaped charges 200, and housing one or more components for detonating the shaped charges, as will be described in further detail hereinbelow.

The exposed perforating gun module includes a housing 120. According to an aspect, the housing 120 is formed from a pre-forged metal blank or shape. The housing 120 may be machined from a solid bar of metal, which may require less metal removal during machining, as compared to typical computer numerical control (CNC) machining procedures where the body is not pre-forged to a certain shape before machining. The CNC process can employ a single set of prompts to three-dimensionally cut a block of material to form the housing 120, which may reduce the time it takes to manufacture the housing 120 and reduce the amount of scrap material generated during the manufacturing process, thereby providing cost savings to the manufacturer and ultimately to end users.

The housing 120 may be configured such that it has a length/housing length L that is most suitable for the application for which it will be used. For example, the housing length L may be selected based on the size and quantity of the components that will be housed therein. has a length L that is less than about 12 inches, alternatively less than about 9 inches. According to an aspect, the length of the housing is less than about 8 inches. The housing may have a length that is less than about 7 inches. The housing length L of each housing may be longer or shorter, based on the needs of the particular application in which it is to be used. The housing 120 can be connected to adjacent housings of adjacent exposed perforating gun modules, without the need for additional connectors, such as the aforementioned tandem seal adapter or tandem sub assembly. It is contemplated, however, that pressure tight connectors may be used to connect perforating gun housings 120 together.

In some embodiments, the housing 120 includes a first connector end 122 and a second connector end 124 spaced apart from the first connector end 122. The first and second connector ends 122, 124 may both be box ends having internal threads formed on each end (not shown). In such a configuration, an internal seal adapter or an internal sub assembly is included in between adjacent housings 120. The internal seal adapter or sub assembly is structured to seal the adjacent housing 120 from each other and from the wellbore environment. It is contemplated that the first and second connector ends 122, 124 may both be male ends with an external seal adapter or sub assembly connecting adjacent housings 120 and sealing the connected adjacent housings 120 from each other and from the wellbore environment. According to an aspect, and as illustrated in FIG. 1B for example, the first connector end 122 is a male end and the second connector end 124 is a female end opposite and spaced apart from the first connector end 122. In this configuration, the first connector end 122 may have an outer diameter OD that is less than an inner diameter ID of the second connecter end 124. This facilitates insertion of the male end 122 of a first perforating into the female end 124 of an adjacent perforating gun, such that the first and adjacent/second perforating guns may be secured together in a daisy chain configuration to form a gun string (FIGS. 15A-15B and FIGS. 16-19). Once multiple perforating exposed gun modules are connected to each other, which typically occurs at the wellsite above the wellbore, each gun module is pressure sealed or pressure tight at atmospheric condition to protect the components housed therein from the wellbore environment.

According to an aspect, the housing 120 is configured with threads to facilitate the connection of multiple exposed perforating gun modules 110 together to form the aforementioned gun string. The threads may also facilitate connection to a wireline for both deployment and retrieval of the exposed perforating gun module from a wellbore. As would be understood by one of ordinary skill in the art, wirelines are typically attached to a cablehead (i.e., wireline cablehead), which serves as the connection mechanism between the exposed perforating gun module and the wireline. The cablehead can be removably coupled/affixed to the second connector end 124 of the housing 120 of the exposed perforating gun module 110. This coupling can be facilitated by threadingly connecting the second connector end 124 to the cablehead. The exposed perforating gun module 110 can therefore be connected and disconnected to the cablehead or other downhole tools. According to an aspect, such downhole tools may include tools used for wellbore monitoring and depth control (such as, a sensor, a CCL (casing collar locator), and the like).

The first and second connector ends 122, 124 may be threadingly connected to adjacent exposed perforating gun modules. The male end 122 may include one or more threads/male threads 123, and the female end 124 may include one or more threads/female threads 125 extending from the second connector end into at least a portion of a chamber 126 of the housing 120. The threads 123, 125 may be one of continuous threads or interrupted threads. As used herein, "continuous threads" may mean a non-interrupted threaded closure having a spiral design (e.g., extending around the skirt like a helix), while "interrupted threads" may mean a non-continuous/segmented threaded pattern having gaps/discontinuities between each adjacent thread. These threads 123, 125 enable the housing 120 to connect to housings of other perforating gun modules, such as other exposed perforating gun modules. The male threads 123, for example, are configured to mate/engage with corresponding female threads 125 of an adjacent exposed perforating gun module, and vice versa. FIGS. 15A-15B and FIGS. 16-19, for example, show the results of respective first connector ends 122 of housings 120 of perforating modules 110 that have been threadingly secured to corresponding second connector ends 124 (i.e., within the chamber 126) of the housings 120 of adjacent exposed gun modules.

According to an aspect, the first connector end 122 of the exposed perforating gun module further includes one or more circumferential channels 121 configured for receiving one or more sealing mechanisms 102. As illustrated in FIGS. 2A-2B, 6, and 10A-10C, the sealing mechanisms 102 may include o-rings. According to an aspect, the sealing mechanisms may include gaskets or any other type of mechanical sealers. The sealing mechanisms 102 help to seal/isolate the components housed in the chamber 126 of the housing 120 of the exposed perforating gun module 110 from the contents of a housing of an adjacent perforating gun, as well as from the outside environment (fluid in the wellbore) from entering the chamber 126. As illustrated in, for example, FIGS. 2A, 5, 13, 15A-15B and 16-17, a washer 129 may be disposed adjacent the first connector end 122 of the housing 120. The washer 129 may serve as a spacer of a seal that helps to spread the pressure when the housing 120 is tightened or between two joining surfaces (such as the first connector end of a first exposed gun module and the second connecter end of another exposed perforating gun module). The washer 129 may include metal, rubber or plastic.

FIGS. 6, 10A-10C and 11 illustrate the chamber 126 extending between the first connector end 122 and the second connector end 124. The chamber may span the length L of the housing 120. The chamber 126 extends along a central axis/Y-axis/central Y-axis of the housing 120 and is configured for receiving a plurality of components, including at least one of electrical components and explosive components. Such components may include a detonator, a radial booster charge, a detonating cord (not shown), a bi-directional booster (not shown), a bulkhead assembly, and any other electrical or explosive components. The chamber 126 includes one or more cavities dimensioned to receive the components. The chamber 126 may include a first cavity 126*a* configured for receiving a first connector end of an adjacent exposed gun module and a second cavity 126*b* configured for receiving a detonator and, optionally, at least one of the aforementioned radial booster charge, detonating cord and bi-directional booster. The chamber 126 may further include a third cavity 126*c* and a fourth cavity 126*d* that are together configured for receiving a bulkhead assembly 500.

Figure 5:
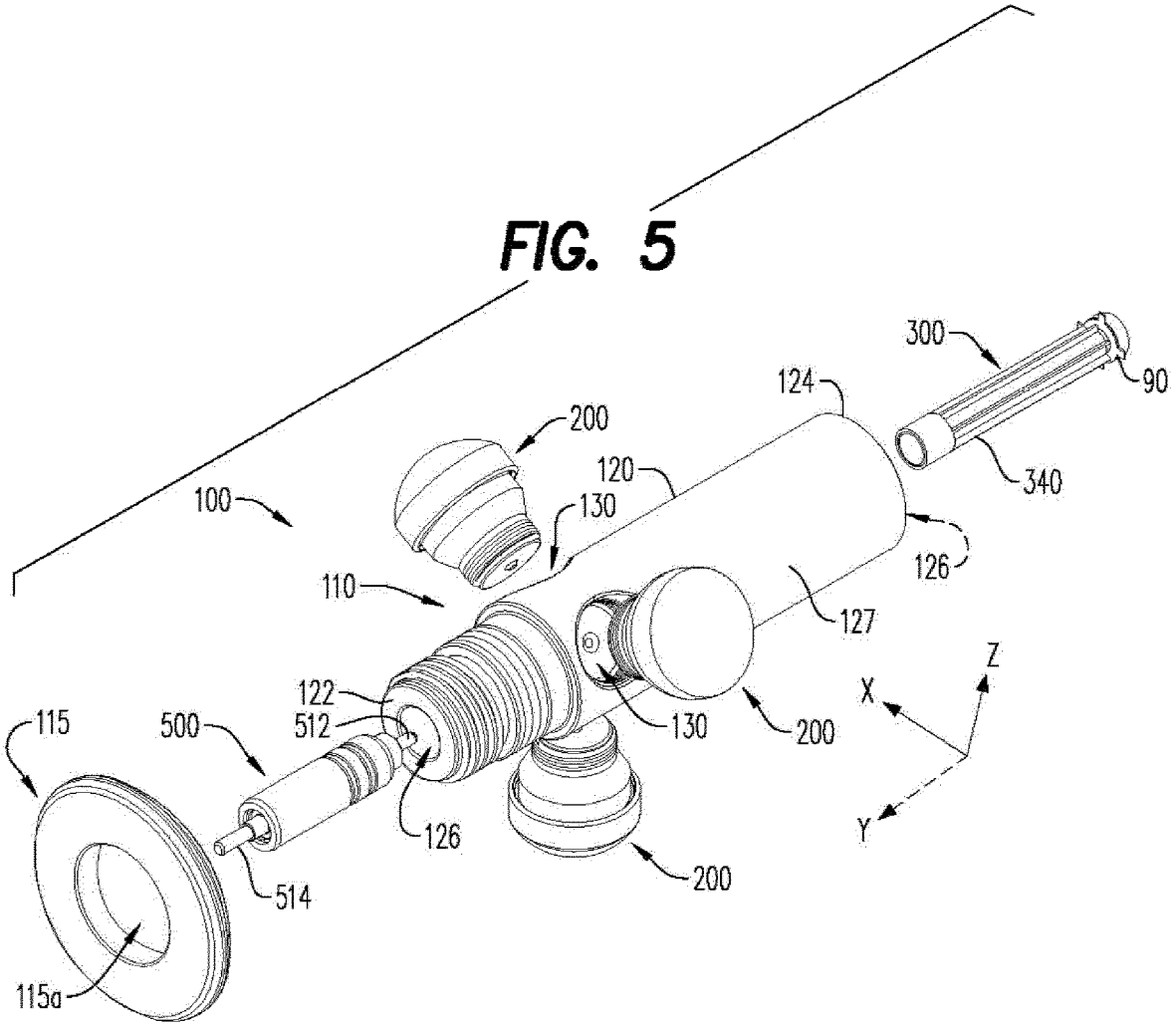
FIG. 5 is an exploded, perspective view of a perforating gun assembly including an exposed perforating gun module according to an embodiment.

As illustrated in FIGS. 1 and 5, for example, a plurality of sockets 130 are formed in an outer surface 127 of the housing 120 and generally extend towards the chamber 126. The sockets 130 may be arranged radially about the central axis Y of the housing 120, such as in a XZ-plane around the central axis Y of the housing. The shaped charges may be initiated by the detonator, or a detonator in combination with a radial booster charge detonating cord or bi-directional booster. While the sockets 130 (and correspondingly, the shaped charges 200) are shown in a radial arrangement about the housing 120 in the exemplary embodiment shown in, for example, FIGS. 1, 2A-2B, 6-7, 10A-10E, 11, 15A-15B, and 16-18, the disclosure is not so limited, and it is contemplated that any arrangement of the shaped charges 200 may be accommodated, within the spirit and scope of this disclosure, by the tethered drone exposed perforating gun module 110. For example, a single socket 130 or a plurality of sockets 130 for respectively receiving a shaped charge 200 may be positioned at any phasing (i.e., circumferential angle) on the housing 120, and a plurality of shaped charge apertures may be included, arranged, and aligned in any number of ways. For example, and without limitation, the sockets 130 may be arranged, with respect to the housing, along a single longitudinal axis (i.e., in line), within a single radial plane, in a staggered or random configuration, spaced apart along a length of the body portion, pointing in opposite directions, etc.

In an embodiment (not shown), each socket 130 is arranged inline, such that they extend in a plane that is parallel to the central axis Y of the housing 120. In yet a further embodiment (not shown), the sockets 130 are arranged about the central axis Y of the housing in a spiral configuration. In these configurations, the shaped charges 200 may be initiated by the detonator, or the detonator in combination with at least one of a radial booster charge, a detonating cord, and a bi-directional booster. The detonating cord may be in direct contact with the detonator (such, as a side-by-side arrangement). If is contemplated that when the assembly includes a detonator and a bi-directional booster, the bi-directional booster may be spaced apart from the detonator.

Each socket 130 is dimensioned to receive a shaped charge/encapsulated shaped charge. One or more of the sockets 130 may be configured as a depression or a countersunk hole formed in the housing 120. The socket 130 may include a base wall 134 having a thin layer of material (such as, for example, a thin layer of the material the housing 120 is machined from) that separates the socket 130 from the chamber 126. The base wall 134 may include a centrally oriented contour 135, such as a depression/dimple or a nipple, formed in the base wall 134. The centrally oriented contour 135 may correspond to the location of an initiation point of a shaped charge 200 retained therein.

Figure 4A:
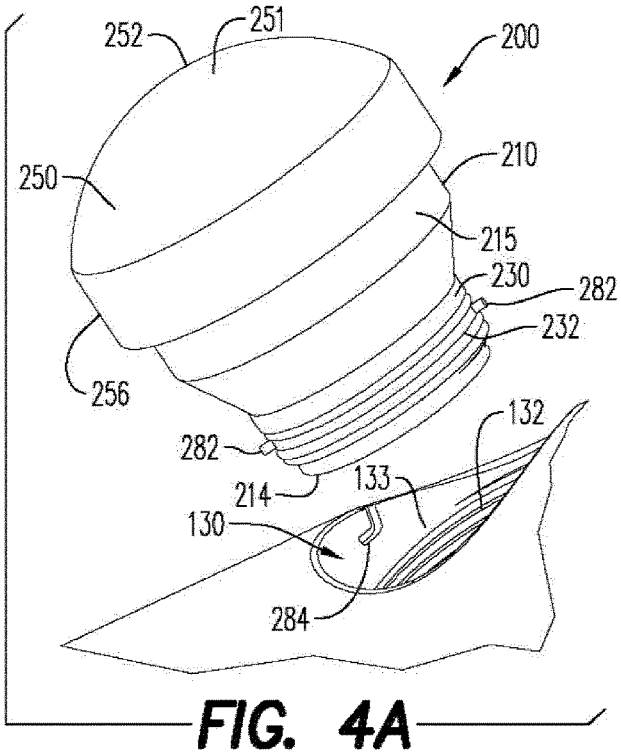
FIG. 4A is a side, perspective view of an encapsulated shaped charge including a bayonet pin for being secured to a bayonet recess in a socket of a perforating gun module, according to an aspect.
Figure 4B:
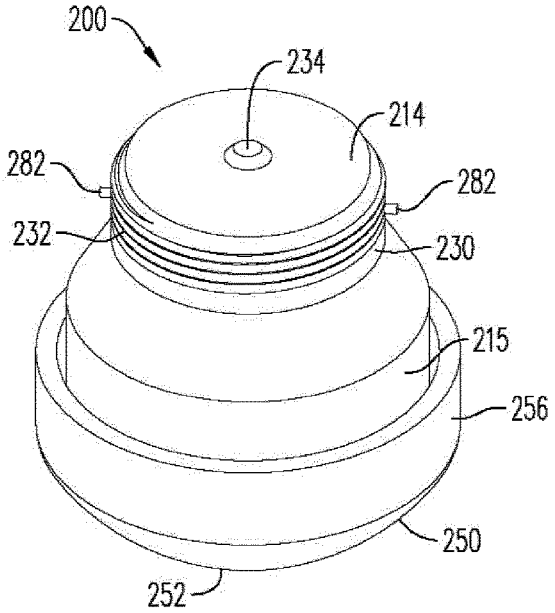
FIG. 4B is a bottom, perspective view of the encapsulated shaped charge of FIG. 4A.
Figure 4C:
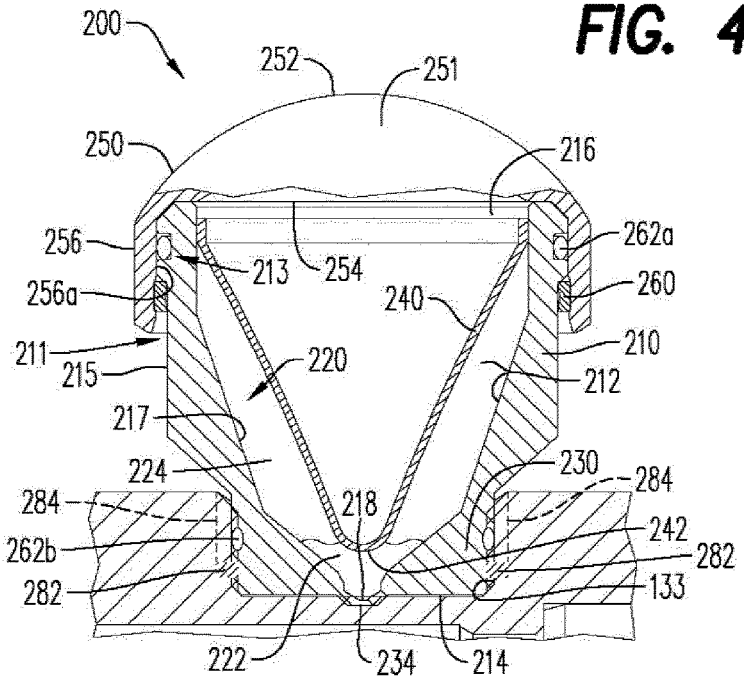
FIG. 4C is a side, cross-sectional view of the encapsulated shaped charge of FIG. 4A, illustrating the bayonet pin secured in the bayonet recess.
Figure 4D:
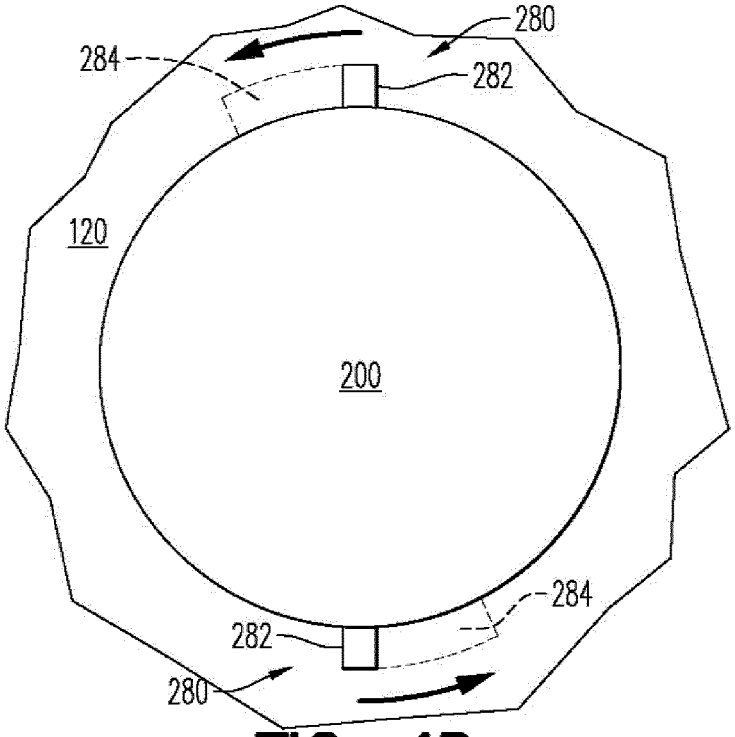
FIG. 4D is a schematic diagram of the connection between the bayonet pin and bayonet recess illustrated in FIG. 4A, with outer arrows to indicate the rotational movement of the bayonet pin in the bayonet recess.
Figure 4E:
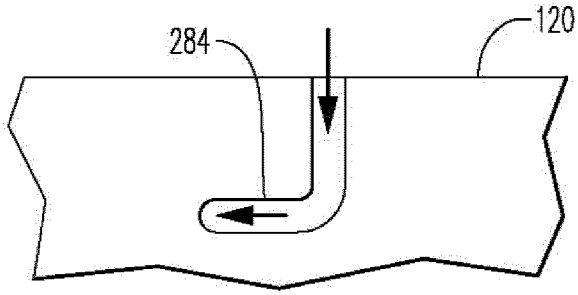
FIG. 4E is a schematic diagram illustrating a shape of the bayonet recess of FIG. 4A.

The housing 120 may include one or more retention mechanisms, such as clips, teeth, and the like, to secure the shaped charges 200 within the sockets 130. The shaped charge may be configured with special contours to facilitate such connections. For example and as illustrated in FIGS. 4A-4E, the shaped charges 200 may be secured to the sockets 130 using securing mechanisms, such as one or more bayonet mounts 280. The bayonet mounts 280 may include, for example, a bayonet lug/bayonet pin 282 and a bayonet recess/female receptor 284 that help to secure the pin 282, and therefore the shaped charges 200, within the sockets 130. As illustrated in FIGS. 4A, 4B and 4C, the bayonet pin 282 may extend from a surface of the shaped charge, while the bayonet recess 284 may be formed in the wall 133 of the socket 130 (FIG. 4A and FIG. 4C). As illustrated in FIG. 4D, for example, the shaped charge 200 may be mounted in the housing 120 by virtue of the bayonet pin 282 partially rotating in the recess 284. The bayonet recess 284 may be configured as an L-shaped slot that receives and helps to secure the bayonet lug 282 therein. (FIG. 4E) While not shown, it is contemplated that the bayonet pin 282 may extend from a back wall of the shaped charge 200, while the bayonet receptor/female receptor 284 may be formed in the base wall 134 of the socket 130.

Figure 6:
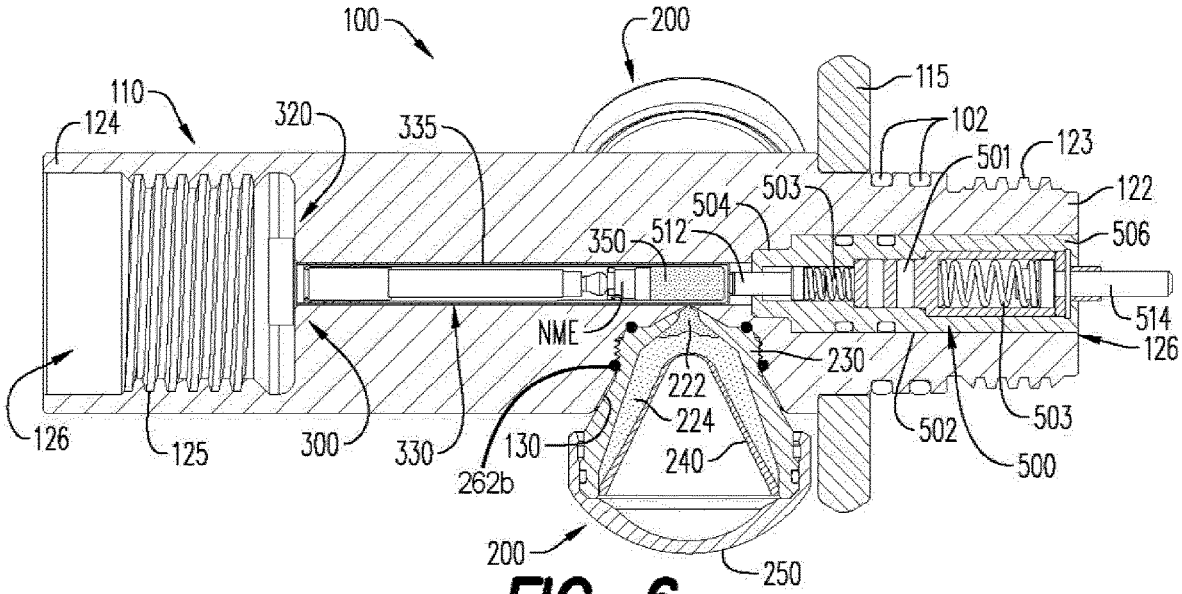
FIG. 6 is a side, partial cross-sectional view of an exposed perforating gun module comprising a plurality of encapsulated shaped charges in open communication with a chamber of a housing of the perforating gun module, and a shield circumferentially positioned on the housing, according to an embodiment.
Figure 7:
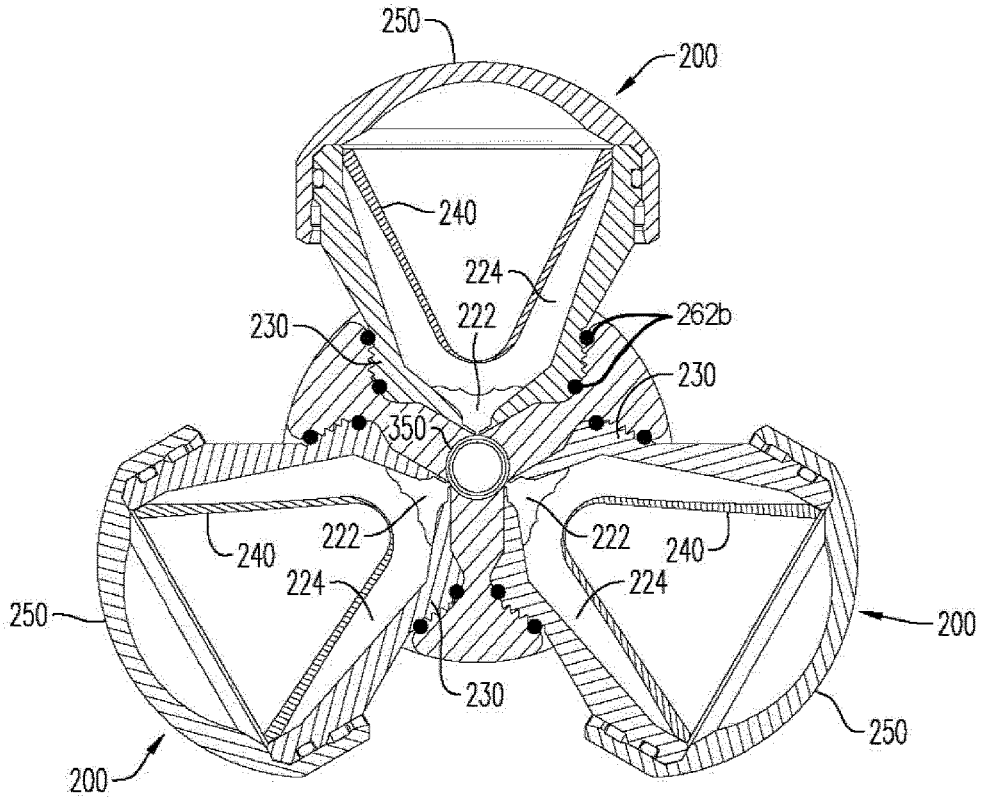
FIG. 7 is a cross-sectional view of the perforating gun module of FIG. 6, illustrating the encapsulated shaped charges in communication with a wireless, push-in detonator.

According to an aspect, the sockets 130 include an internal thread 132 to threadingly secure the shaped charge 200 therein. The internal thread 132 may be a continuous thread or interrupted threads that mate or engage with corresponding threads 232 formed on a back wall protrusion 230 of a shaped charge 200 (as discussed with respect to FIGS. 3A and 3B). While the exposed perforating gun module of FIG. 1 is illustrated as having the base wall 134, it is contemplated that at least one of the sockets 130 may be in open communication with the chamber 126 (FIGS. 6-7). As illustrated in FIG. 6 and FIG. 7, the sockets 130 may be equipped with one or more sealing members/pressure stabilizing devices 262*b* to prevent wellbore fluids from entering the chamber 126 of the housing 120.

Further embodiments of the disclosure are associated with a perforating gun assembly 100. As illustrated in FIGS. 2A-2B and 5, the perforating gun assembly 100 includes the aforementioned exposed perforating gun module 110 and a plurality of encapsulated shaped charges 200 secured therein. The exposed perforating gun module 110 may be configured substantially as described hereinabove. Thus, for purpose of convenience, and not limitation, the features and characteristics of the exposed perforating gun module 110 are not repeated here. The perforating gun assembly 100 is an exposed perforating gun system with a pressure tight (non-exposed) central support structure (i.e., the exposed perforating gun module 110). The housing 120 of the exposed perforating gun module 110 is fully retrievable from the wellbore. The exposed perforating gun module 110 houses the initiation and ballistic transfer components, and mechanically secures the encapsulated shaped charges 200 in all industry standard or other desired configurations and phasings, including, but not limited to three charges in a single plane (radially or circumferentially about the housing 120 in a single plane, along a length of the housing 120 in a single plane, and the like), and a plurality of charges arranged in a spiral along the length of the housing 120.

FIGS. 2A-2B, 6, 10A-10C, 11 and 13-14, among others, illustrate the exposed perforating gun module 110 having encapsulated shaped charges 200 secured within the sockets 130. The encapsulated shaped charges 200 are secured to the sockets 130 in an outward, radial arrangement. As used herein, the term "outward" generally means that the shaped charges 200 are oriented such that a perforating jet created by the shaped charges 200 will fire in a direction away from the chamber 126. The outward arrangement of the shaped charges 200 help to facilitate the explosive contents 220, 222 (FIG. 4) of the shaped charges being in ballistic communication with explosive components within the chamber 126 of the housing 120 of the exposed perforating gun module 110.

Figure 3A:
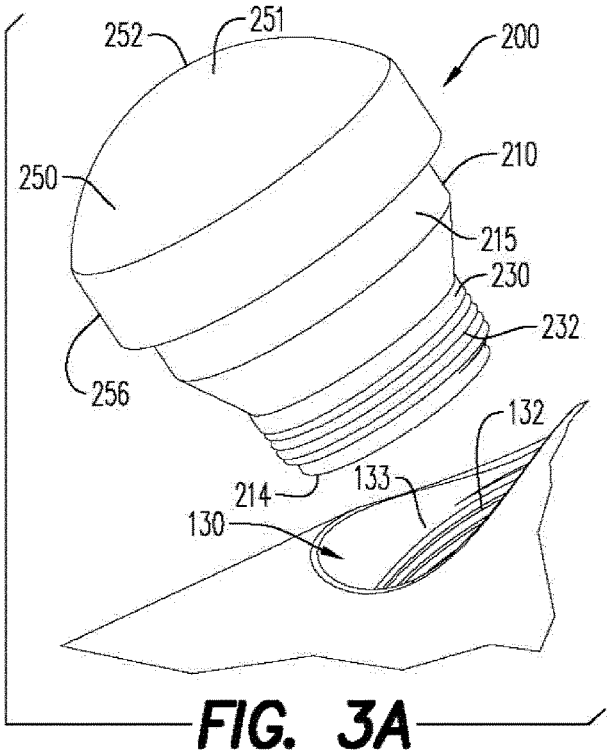
FIG. 3A is a side, perspective view of an encapsulated shaped charge detached from a housing of an exposed perforating gun module, according to an embodiment.
Figure 3B:
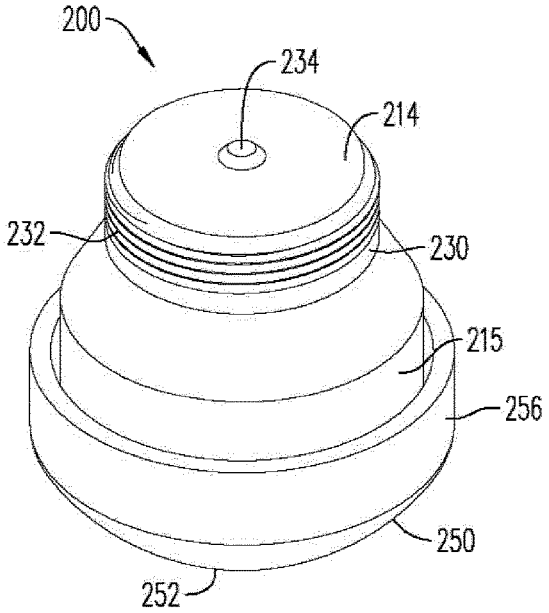
FIG. 3B is a bottom, perspective view of the encapsulated shaped charge of FIG. 3A.
Figure 3C:
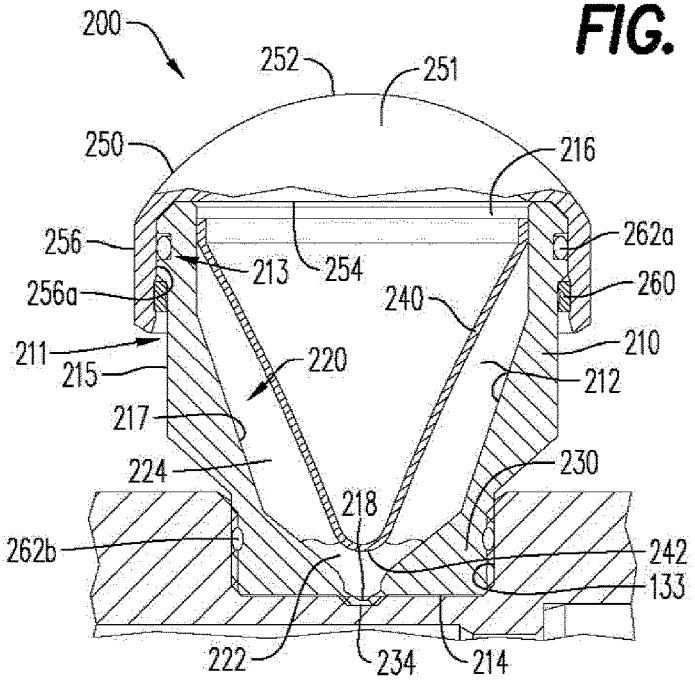
FIG. 3C is a side, cross-sectional view of the encapsulated shaped charge of FIG. 3A, according to an embodiment.

The encapsulated shaped charges 200 are illustrated in FIGS. 3A-3B and FIG. 4 in detail. Each shaped charge 200 includes a case 210 having, among other things, a cavity 212, a closed end 214, and an open end 216 opposite and spaced apart from the closed end 214. The closed end 214 of the case 210 may include one or more securing mechanisms, such as those described hereinabove, to secure the shaped charge to a structure, such as the aforementioned housing 120. According to an aspect, such securing mechanisms includes bayonet mounts formed at any location on the closed end 214 to secure the shaped charges 200 to the housing 120.

As illustrated in FIGS. 3A-3B, the case 210 may include a back wall protrusion 230 that extends from the closed end 214 in a direction towards the open end 216. The back wall protrusion 230 may include the bayonet mount described hereinabove. According to an aspect, the back wall protrusion 230 includes an external thread 232 for mating with the internal thread 132 of a corresponding socket 130 as described further below. A side wall 215 extends from the back wall protrusion 230 in a direction towards the open end 216, such that the side wall 215 is positioned between the back wall protrusion 230 and the open end 216 and the cavity 212 is bound by the side wall 215, the back wall protrusion 230, and the closed end 214 of the case 210.

The external thread 232 of the back wall protrusion 230 is configured for engaging the internal thread 132 of the socket 130, thereby securing the encapsulated shaped charge 200 to the socket 130. According to an aspect, the external threads 232 of the back wall protrusion 230 may be one of continuous or interrupted threads, such as those described hereinabove with respect to the first connecter end 122 and the second connector end 124 of the exposed perforating gun module. The one or more sealing members 262*b* may be positioned on the back wall protrusion 230 to prevent wellbore fluids from entering and partially filling at least one of the socket 130 and the chamber 126 of the housing 120 when the shaped charge is positioned and secured in the socket 130. In an exemplary embodiment, the sealing members 262*b* are o-rings formed from any known compressible material(s) consistent with this disclosure, and are compressed between a portion of, e.g., one or more of the closed end 214, the back wall protrusion 230 and the side wall 215 of the case 210 and the wall 133 of the socket 130.

FIG. 3B and FIG. 4 illustrate a contoured region 234 formed at the closed end 214 of the shape charge case 210. The contoured region 234 may be configured as a nipple extending away from the cavity 212 of the shaped charge 200 and having a geometry that is complimentary to the depression 135 formed in the base wall 134 of the socket 130. It is also contemplated that the contoured region 234 may be a dimple/depression extending towards the cavity 212 of the shaped charge 200 and the base wall 134 of the socket 130 may have a complimentarily-shaped nipple. The contoured region 234 may be adjacent an initiation point 218 of the case 210. As would be understood by one of ordinary skill in the art, the initiation point 218 is a thinned region or opening at the closed end 214 of the case, which facilitates ease of transmission of a shock wave to an explosive load 220 (described in detail hereinbelow) upon initiation of the detonator 300 or radial booster charge 400.

FIG. 4 illustrated the explosive load 220 disposed in the case 210. It is contemplated that at least some of the explosive load 220 may be disposed within the initiation point 218. The explosive load 220 is disposed in the cavity 212 of the case 210 such that the explosive load 220 is adjacent an internal surface 217 of the case 210. According to an aspect, the explosive load 220 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), hexanitrostibane (HNS), diamino-3,5-dinitropyrazine-1-oxide (LLM-105), pycrlaminodinitropyridin (PYX) and triaminotrinitrobenzol (TATB).

The explosive load 220 may be positioned in the cavity 212 in increments, such that the explosive load 220 includes multiple layers. According to an aspect, the explosive load 220 includes a first layer disposed in the cavity 212 adjacent the closed end 214, and a second layer atop the first layer. The first layer includes a first explosive load 222, while the second layer includes a second explosive load 224. The first explosive load 222 may be composed of pure explosive powders, while the second explosive load 224 includes a binder. As seen in FIG. 4, for instance, at least a portion of a first explosive load 222 may be disposed in a portion of the contoured region 234. The first explosive load 222 or may extend around the contoured region 234 of the closed end 214.

A liner 240 is in a covering relationship with the explosive load 220. The liner 240 is composed of various constituents, such as powdered metallic and non-metallic materials, powdered metal alloys and binders. The constituents of the liner 240 may be compressed to form a desired liner shape including, without limitation, a conical shape as shown in FIGS. 4 and 7, a hemispherical or bowl-shape, or a trumpet shape. The liner 240 includes an apex 242 that extends into the explosive load 220 (or second explosive load 224) towards the closed end 214. When the shaped charges 200 include the aforementioned first and second explosive loads 222, 224, the liner 240 may extend into the first explosive load 222. The explosive load 220 (including, for example, the first and second explosive loads 222, 224) is positioned, within the cavity 212 of the case 210, between the liner 240 and the internal surface 217 of the case 210, and enclosed therein.

The shaped charge includes a closure member 250 in a covering relationship with the open end 216 of the case 210. The closure member 250 includes a closed portion 252 and an open portion 254. The closed portion 252 has an outwardly domed surface 251. In order words, the closed portion 252 extends away from the open end 216 of the shaped charge case 210. The outwardly domed surface 251 is a geometrically contoured surface that reduces friction between the shaped charge when the perforating gun assembly is being run into the wellbore, or in some instances, where a perforating gun assembly having non-detonated shaped charges is being removed from the wellbore. According to an aspect, the configuration of the outwardly domed surface 251 may help the shaped charges 200 withstand pressures in the wellbore. A skirt 256 extends from an edge of the closed portion 252 in a direction away from the outwardly domed surface 251. The skirt 256 may be integrally formed with the closed portion 251. The skirt has an inner surface 256*a* that engages an external surface 211 of the case 210 to secure the closure member 250 to the shaped charge case 210.

While the closure member 250 may be secured to the case 210 with a friction fit, crimping, rolling or swedging, one or more securing mechanisms may be provided to prevent the closure member 250 from being unintentionally dislodged from the case 210. Such securing mechanisms may include melting rings, grooves, click-rings, notches and the like. FIG. 4 illustrates a melting ring 260 positioned between the inner surface 256*a* of the skirt 256 and the external surface 211 of the case 210. The melting ring 260 helps to mechanically fix the closure member 250 to the case 210 and creates a mechanical seal between the case 210 and the skirt 256. The case 210 may include one or more grooves 213 formed in its external surface 211, adjacent the open end 216. Each groove 213 may be configured to receive and secure a sealing member/pressure stabilizing device 262*a* therein. When the closure member 250 is secured to (or in sealing engagement with) the case 210, the sealing member 262*a* helps to prevent wellbore fluids or other unwanted items from entering the cavity 212 of the case 210. The sealing member 262*a* may include an o-ring formed from any known compressible material(s) consistent with this disclosure, and is compressed between a portion of, e.g., the skirt 256 and the case 210.

One or more components of the exemplary shaped charges 200, such as the case 210 and/or the closure member 250 may include a zinc alloy. The zinc alloy may include up to about 95% w/w zinc. According to an aspect, the zinc alloy includes up to about 95% w/w zinc. It is contemplated that the zinc alloy may include up to about 6% w/w of an aluminum copper alloy. The incorporation of the zinc alloy into the shaped charge case 210 and/or the closure member 250 helps to reduce the debris that is formed upon detonation of the shaped charges 200. Rather than forming debris (including, for example, shrapnel that can result in obstructions in the wellbore), the detonated shaped charges form a pulverized material that does not obstruct the wellbore and does not need to be retrieved from the wellbore.

According to an aspect, an initiator is secured within the chamber 126 of the housing 120 of the exposed perforating gun module 110. The initiator may be configured to receive a signal/command from the surface of the wellbore. As would be understood by one of ordinary skill in the art, the initiator may be an igniter or a detonator. The igniter or the detonator may be wired or wireless. In the exemplary embodiment(s) shown in FIGS. 6, 8A-8C, 9, 10A-10C, 11 and 14, the detonator 300 is a wireless, push-in detonator 300, although other wired detonators or igniters (FIG. 20) may also be used. The wireless, push-in detonator 300 may be configured to directly initiate the encapsulated shaped charges 200 or initiate a booster charge 400 that initiates the encapsulated shaped charges 200 (described in further detail hereinbelow) in response to a digital initiating code.

FIGS. 8A-8C and FIG. 9 illustrates the wireless, push-in detonator 300 in detail. The wireless, push-in detonator 300 includes a detonator head 320. The detonator head 320 includes a line-in portion 322, a ground portion 324, and an insulator 326 extending at least partially between the line-in portion 322 and the ground portion 324. The ground portion 324 is located at an underside of the detonator head 320, while the line-in portion is located at an upper side of the detonator head 320. The wireless, push-in detonator 300 includes a detonator shell 330 adjacent the ground portion 324. The detonator shell 330 may include a metal, and may be configured with a lineout portion 331, which may transfer the electrical signal to a bulkhead assembly 500 (described in further detail hereinbelow). The detonator shell 330 includes an open end 333 and a closed end 332 opposite and spaced apart from the open end 333. According to an aspect, the detonator shell 330 houses a main explosive load 350 adjacent the closed end 332, a non-mass explosive (NME) body adjacent the main explosive load 350, and an electronic circuit board (ECB) 334 between the NME body and the open end 333. The NME body houses a primary explosive including at least one of lead azide, silver azide, lead styphnate, tetracene, nitrocellulose and BAX. According to an aspect, the NME body separates the main explosive load 330 from the ECB. The NME body may be formed of an electrically conductive, electrically dissipative or electrostatic discharge (ESD) safe synthetic material. According to an aspect, the NME body includes a metal, such as cast-iron, zinc, machinable steel or aluminum. The NME body may be formed using any conventional CNC machining or metal casting processes. Alternatively, the NME body is formed from an injection-molded plastic material.

The ECB is configured with contact points that facilitates the upper portion of the detonator head 320 including the line-in portion and the detonator shell 330 including the lineout potion 331. The ECB is configured for receiving an ignition signal, which results in the activation/initiation of the main explosive load 350.

Figure 11:
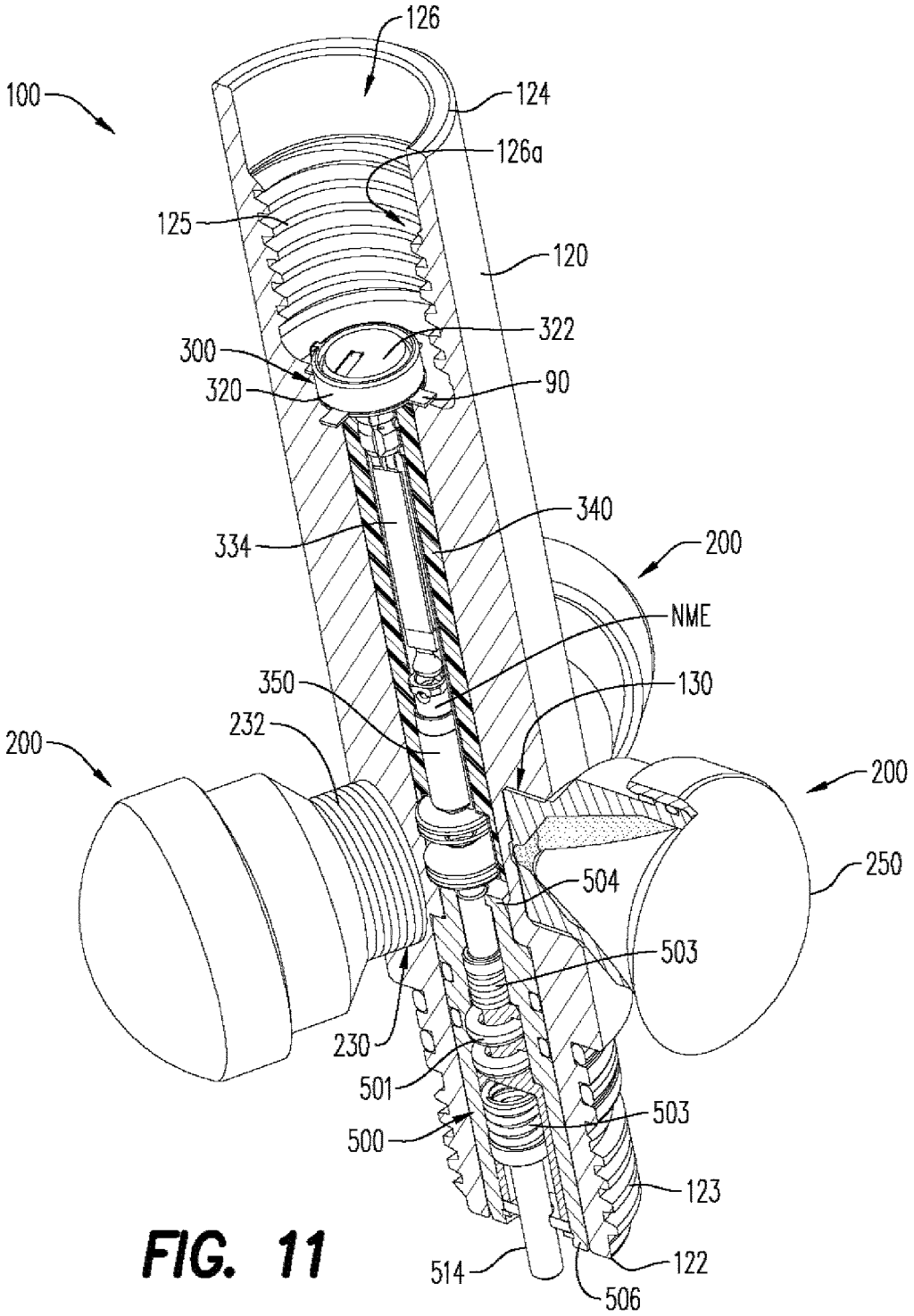
FIG. 11 is a top down, partial cross-sectional view of an exposed perforating gun module, illustrating shaped charges threadingly secured in a housing of the perforating gun module, according to an embodiment.
Figure 12A:
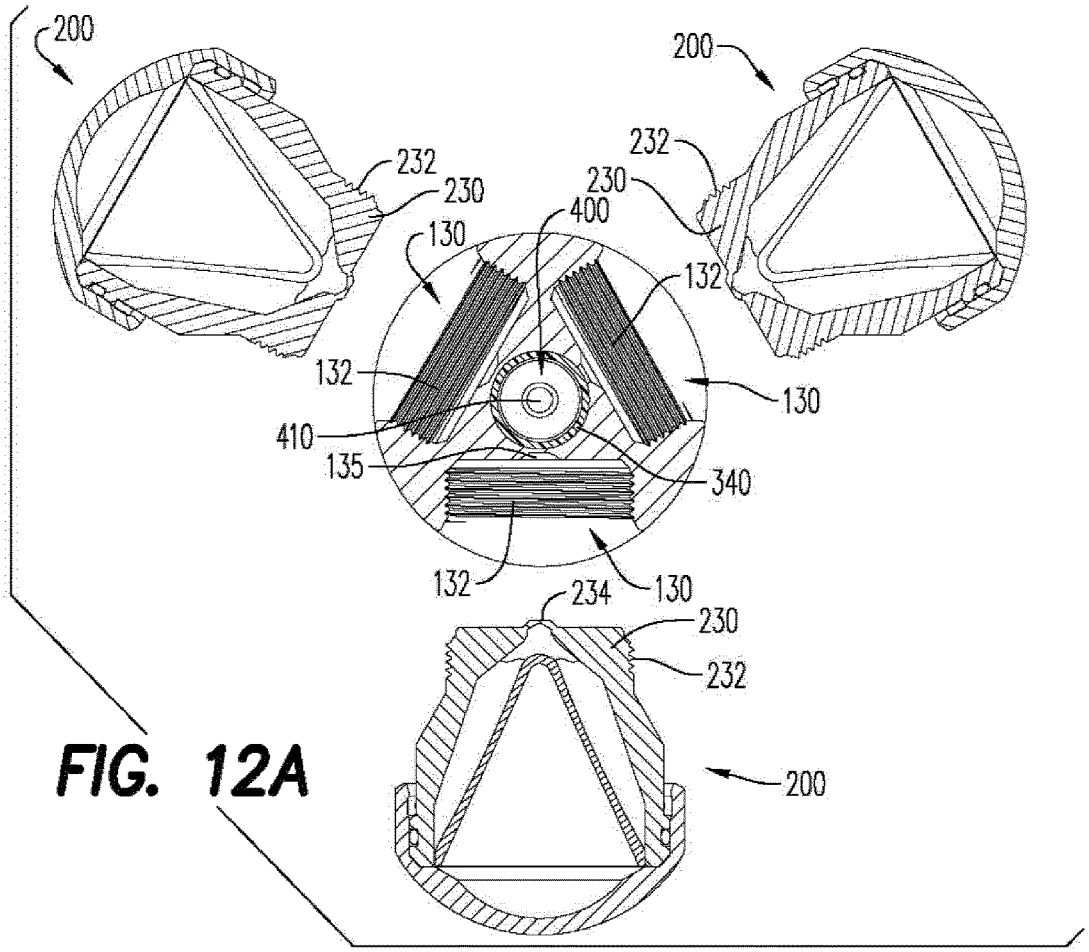
FIG. 12A is a cross-sectional, exploded view of encapsulated shaped charges and a perforating gun module, according to an embodiment.
Figure 12B:
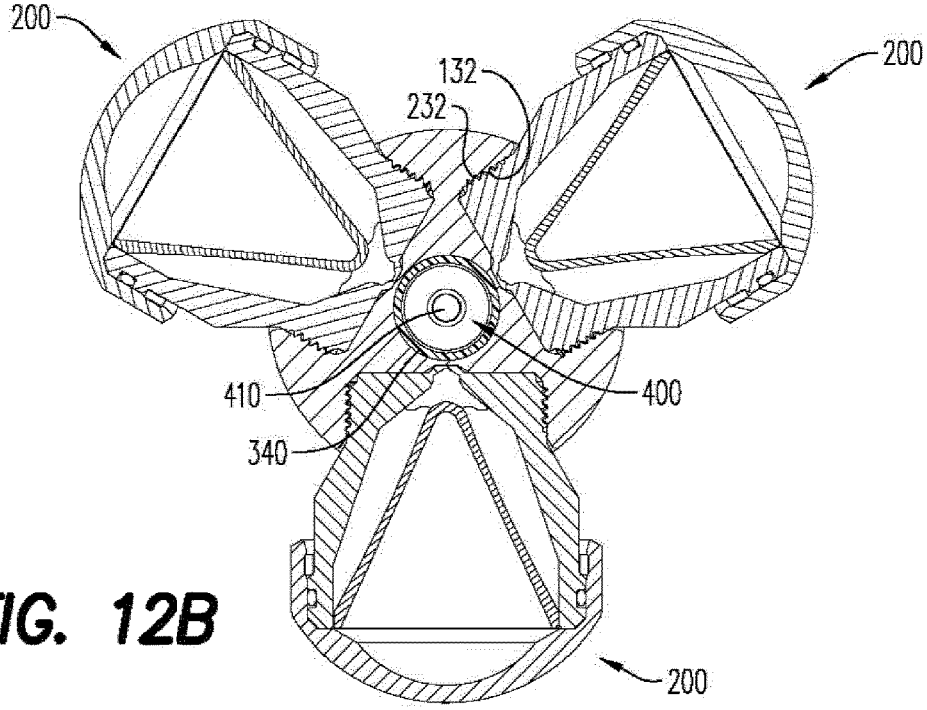
FIG. 12B is a cross-sectional view of the encapsulated shaped charges secured to the perforating gun module of FIG. 12A.
Figure 13:
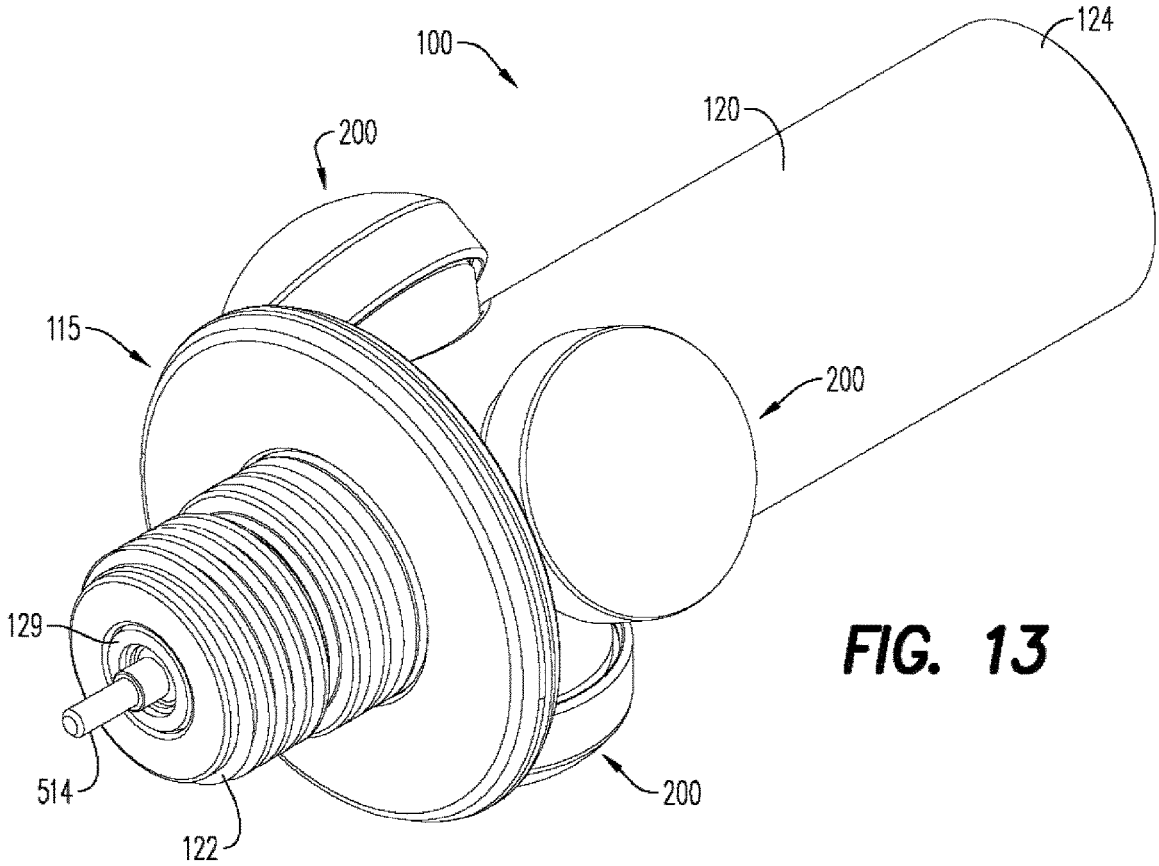
FIG. 13 is a bottom up, perspective view of an exposed perforating gun module comprising encapsulated shaped charges and a shield, according to an embodiment.
Figure 14:
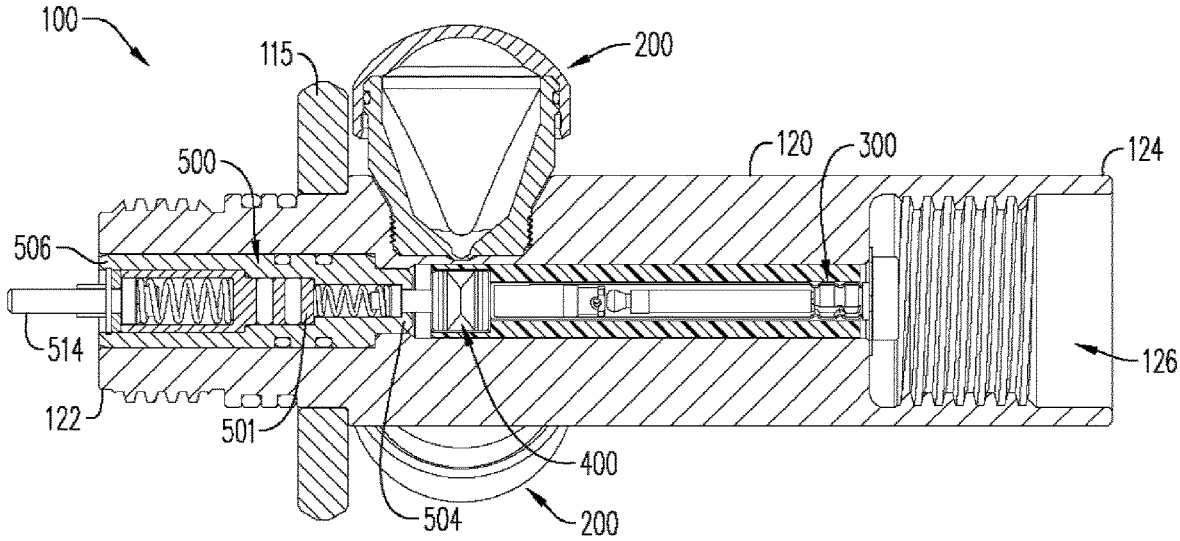
FIG. 14 is a perspective, cross-sectional view of the perforating gun module of FIG. 13.
Figure 15A:
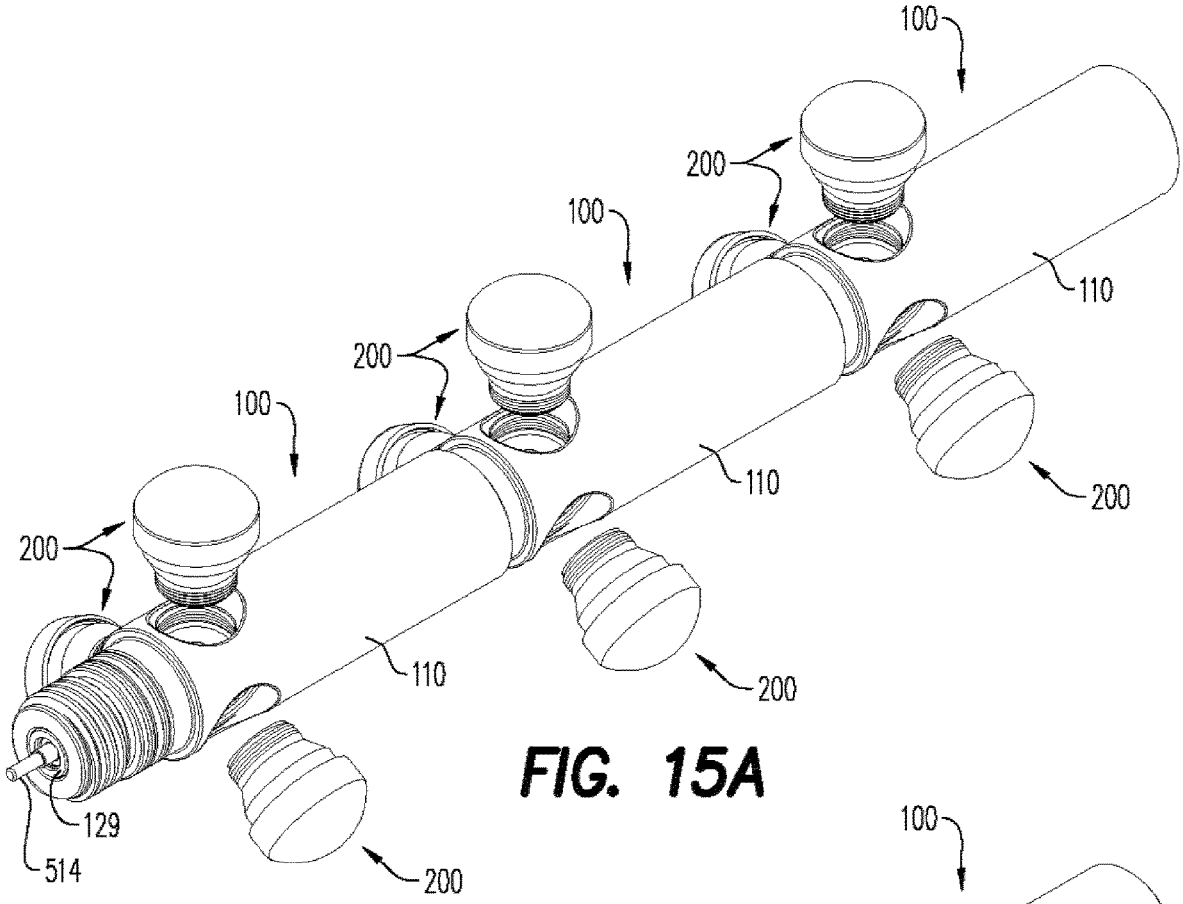
FIG. 15A is a partial exploded view of a chain of exposed perforating gun modules operatively connected together, according to an embodiment.
Figure 15B:
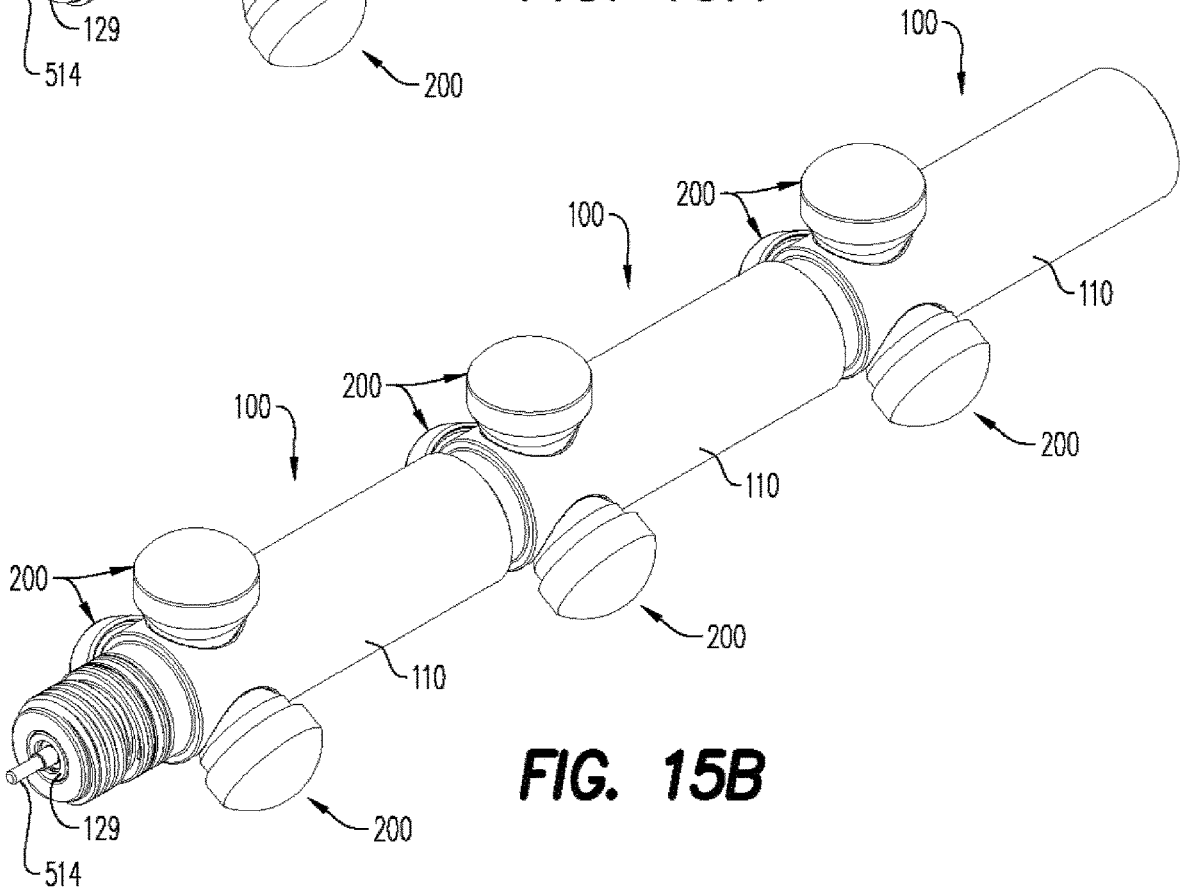
FIG. 15B is a perspective view of the chain of exposed perforating gun modules of FIG. 15A, illustrating a gap between each perforating gun module.
Figure 16:
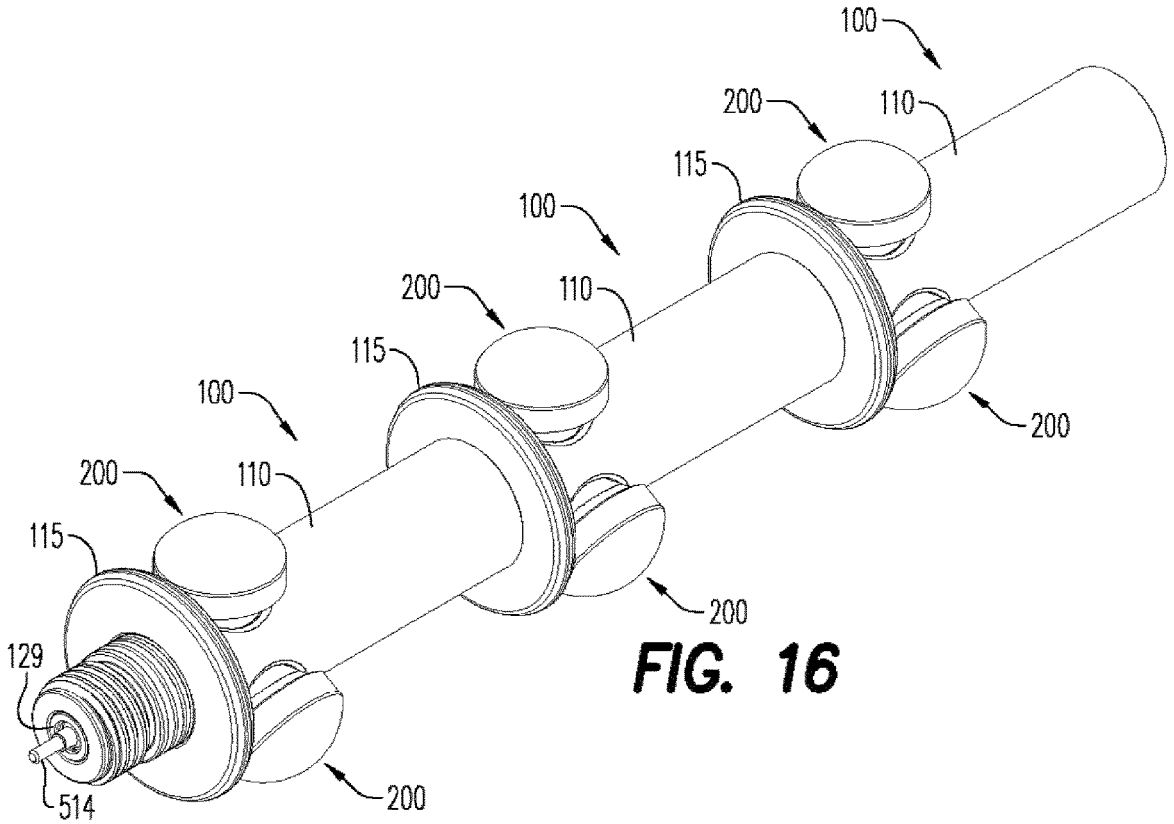
FIG. 16 is a perspective view of the chain of exposed perforating gun modules of FIG. 15B, illustrating a shield positioned in each gap.
Figure 17:
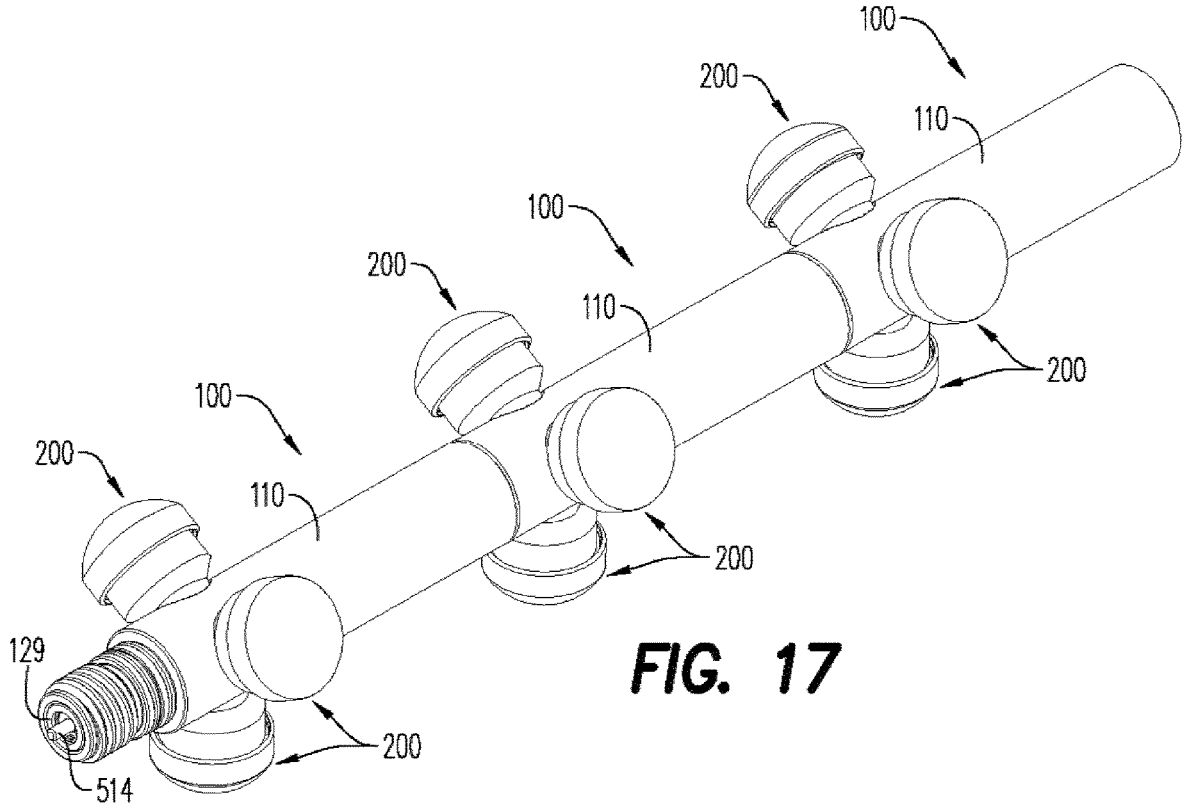
FIG. 17 is a perspective view of the chain of exposed perforating gun modules of FIG. 15B, illustrating each perforating gun module fittingly connected to each adjacent perforating gun module.
Figure 18:
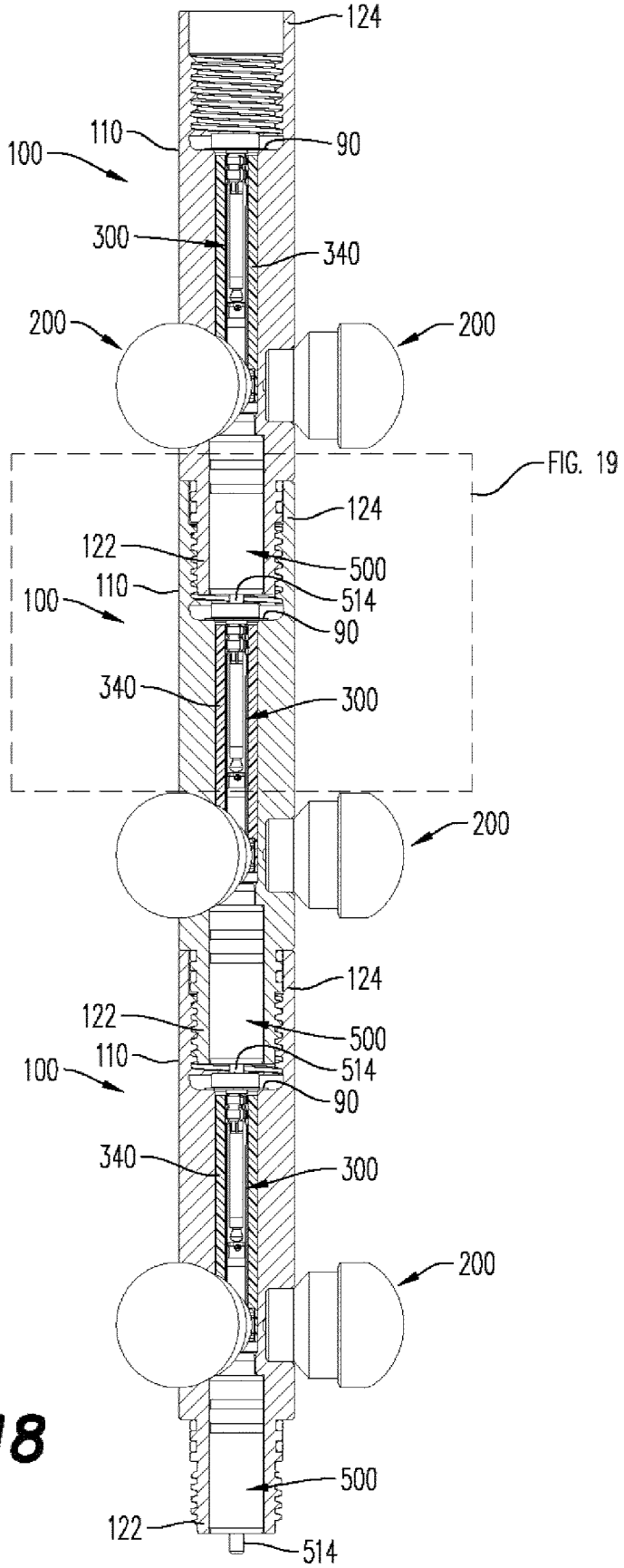
FIG. 18 is a partial, cross-sectional view a chain of exposed perforating gun modules, illustration bulkhead assemblies in communication with wireless, push-in detonators, according to an aspect.
Figure 19:
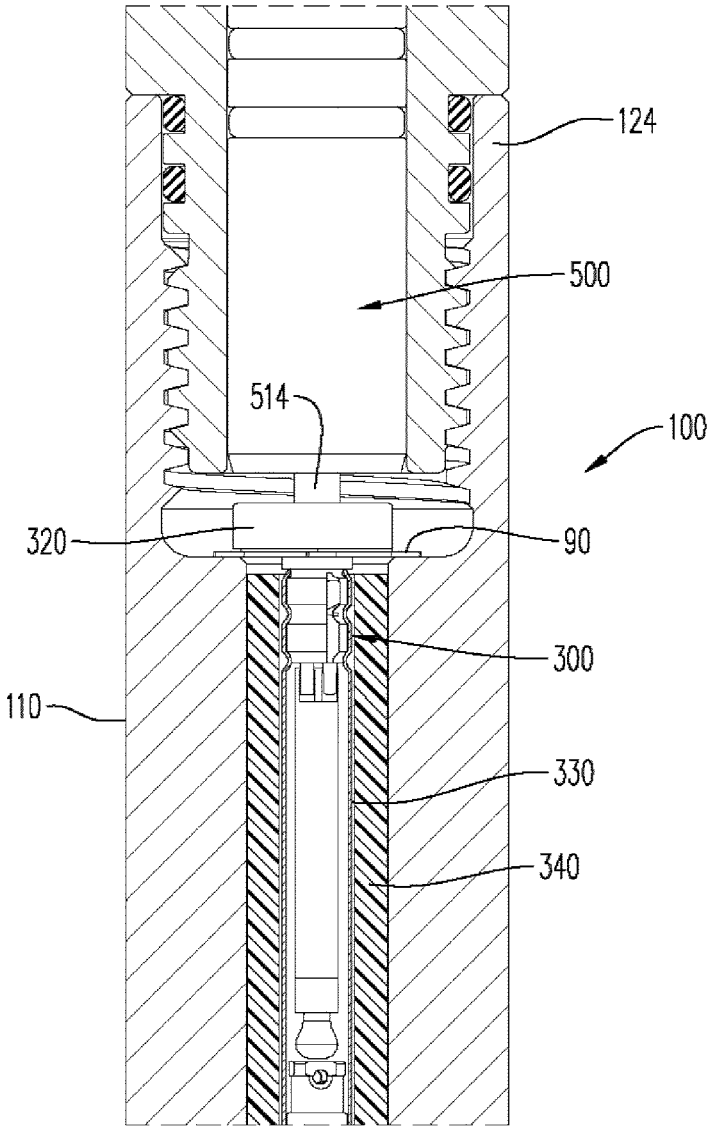
FIG. 19 is a partial, cross-sectional view of the chain of exposed perforating gun modules of FIG. 18.

According to an aspect and as illustrated in FIGS. 5 and 11, an electrical ground 90 may contact the detonator 300. For example, the electrical ground/ground bar 90 may be secured to the detonator 300 so that it is located between the lineout portion 331 (i.e., the detonator shell 330) and the ground portion 324 (i.e., the underside of the detonator head 320) (see, for example, FIG. 9). The electrical ground 90 may be configured as a ground ring having a through hole that facilitates the ring being able to circumferentially extend around the shell 330 of the detonator 300. When the second connector end 124 of the exposed perforating gun module 110 is threaded into a first connector end of an adjacent exposed perforating gun module, the electrical ground 90 of the exposed perforating gun module 110 contacts the first connector end of the adjacent exposed gun module, as seen for example, in FIG. 18 and FIG. 19 According to an aspect, the electrical ground 90 is formed from a stamped, laser cut, or water-jet cut sheet of metal. The electrical ground 90 may be formed from at least one of stainless steel, brass, copper, aluminum or any other electrically conductive sheeted material which can be stamped and re-worked, water jet cut or laser cut.

Figure 8A:
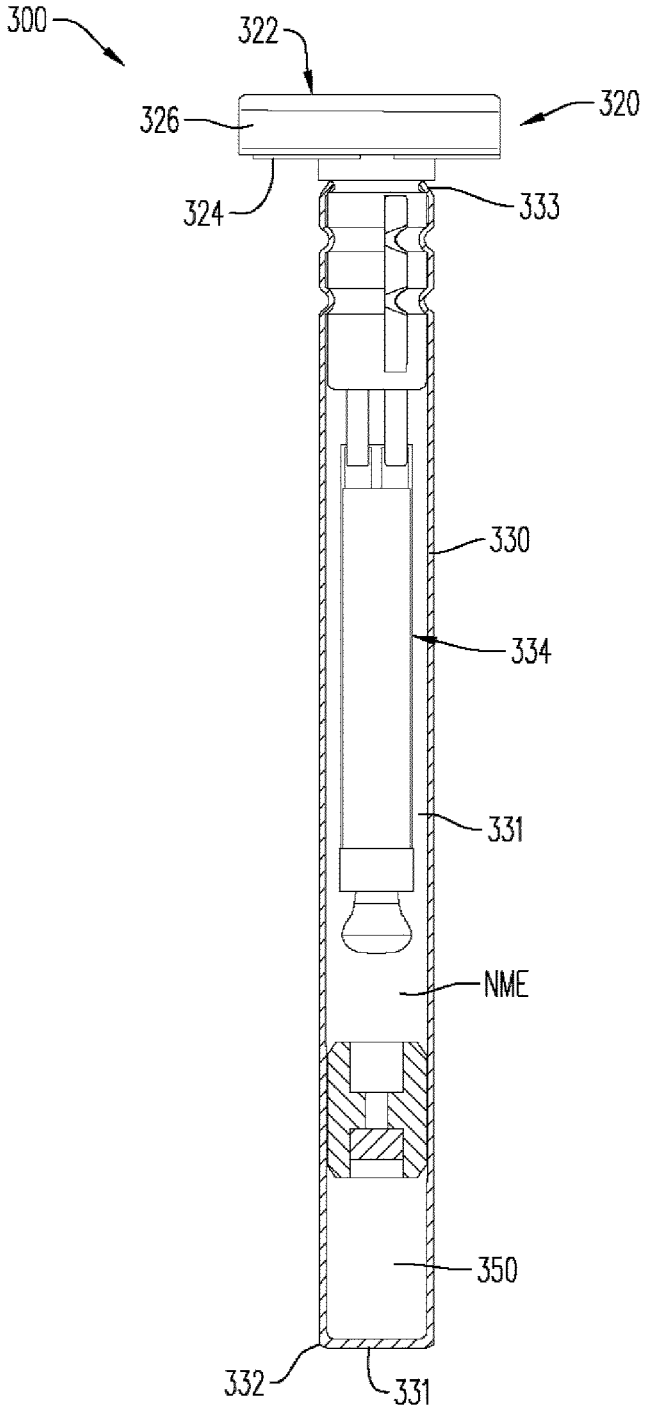
FIG. 8A is a cross-sectional view of a wireless, push-in detonator, according to an embodiment.
Figure 8B:
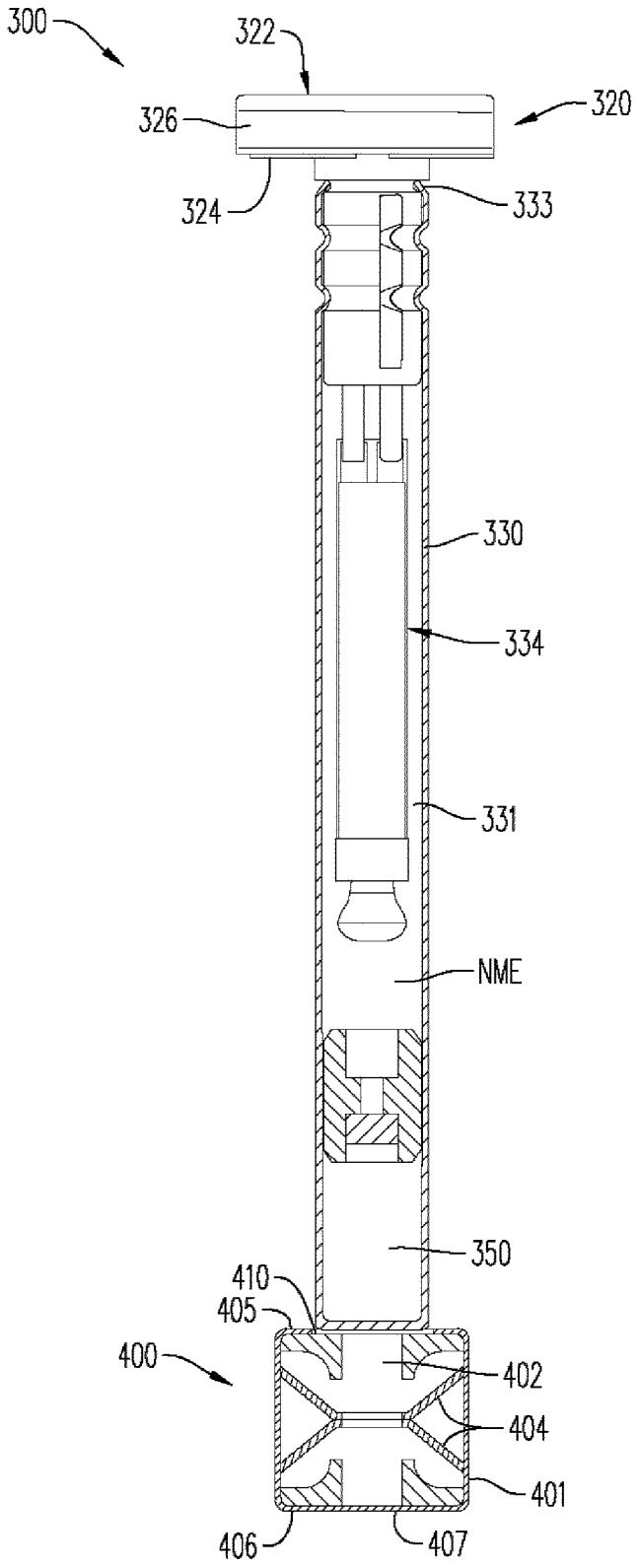
FIG. 8B is a cross-sectional view of a radial booster charge coupled to a wireless, push-in detonator, illustrating a lineout portion of the radial booster charge, according to an embodiment.
Figure 8C:
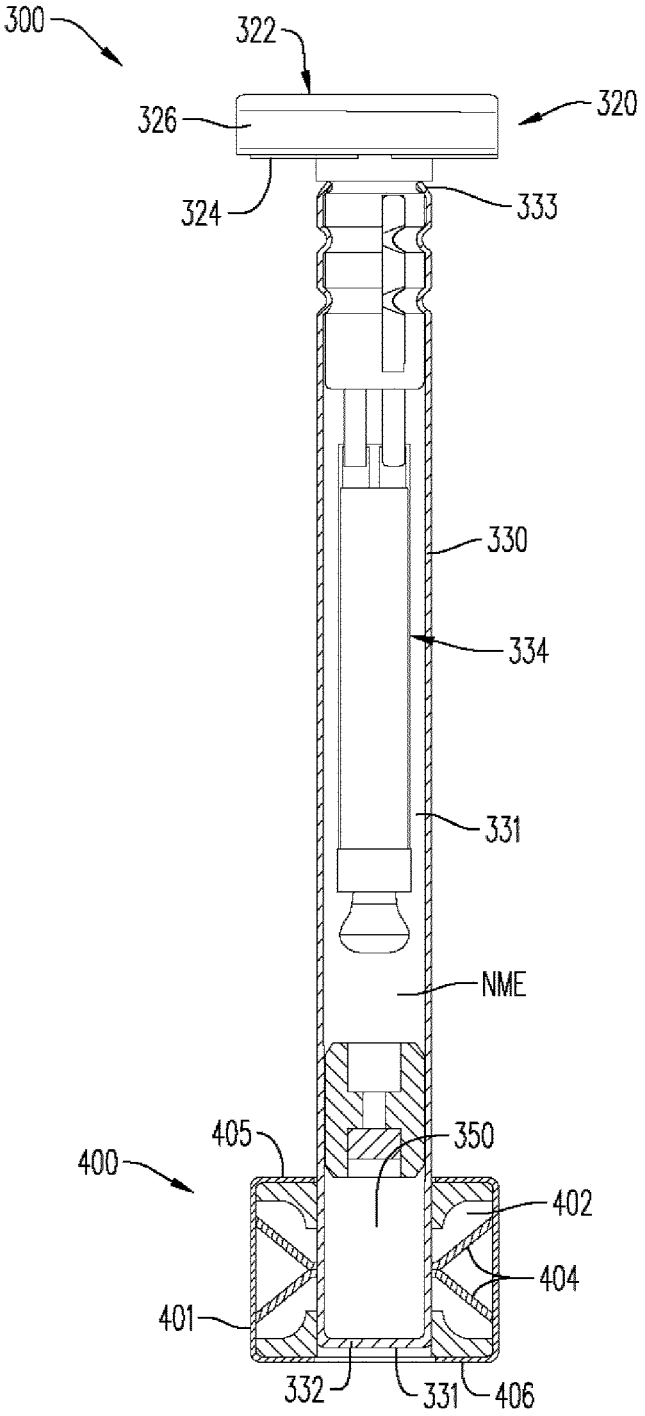
FIG. 8C is a cross-sectional view of a radial booster charge coupled to a wireless, push-in detonator, illustrating a lineout portion of the wireless, push-in detonator, according to an embodiment.

According to an aspect and as illustrated in FIGS. 8B and 8C, the radial booster charge 400 of certain embodiments is positioned adjacent the closed end 332 of the detonator shell 330. The radial booster charge 400 may be positioned so that it is in the same axial plane as each of the encapsulated shaped charges 200 (i.e., the encapsulated shaped charges 200 surround the radial booster charge 400). As illustrated in FIGS. 10A-10C, 11 and 14, the radial booster charge 400 is positioned within the chamber 126 of the housing 120, such that it is adjacent the detonator shell 330 and behind each socket 130.

Figure 8D:
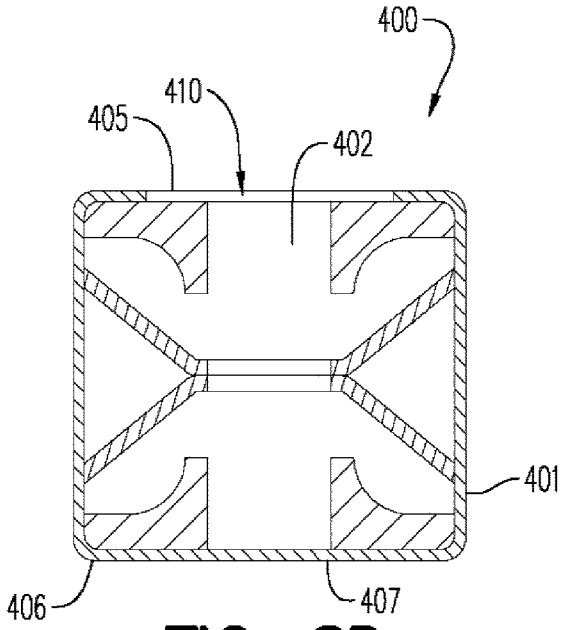
FIG. 8D is a cross-sectional view of a radial booster charge, according to an embodiment.

FIG. 8D shows the radial booster charge 400 in detail. According to an aspect, the radial booster charge 400 includes an explosive 402 extending around/along a central axis of a body (such as, a metal housing/metal body) 401 of the radial booster charge 400. The explosive 402 may include pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), hexanitrostibane (HNS), diamino-3,5-dinitropyrazine-1-oxide (LLM-105), pycrlaminodinitropyridin (PYX), and triaminotrinitrobenzol (TATB). The explosive 402 may include any standard explosive material that is used in shaped charges, as would be understood by one of ordinary skill in the art. According to an aspect, the explosive 402 is retained or otherwise secured within the body 401 of the radial booster charge 400 by a liner 404. According to an aspect, the liner 404 of the radial booster charge 400 includes various powdered metal components. The liner 404 may be configured substantially the same as the liner 240 of the encapsulated shaped charges 200. The radial booster charge 400 may be directly initiated by the detonator 300. Upon initiation, the radial booster charge 400 produces a radial explosive force that initiates each of the encapsulated charges 200 in the axial plane of the radial booster charge 400.

As seen for instance in FIGS. 8B and 8D, the body 401 of the radial booster charge 400 may include a central opening 410 that extends along the same axis as the detonator shell 330. The central opening 410 extends through the body 401 of the radial booster charge, from an upper end 405 to a lower end 406. The central opening 410 extends along the Y-axis of the housing 120. According to an aspect, the central opening 410 of the radial booster charge 400 is sized for receiving at least a portion of the detonator shell 330 within the central opening 410, such that the radial booster charge 400 surrounds the portion of the detonator shell 330 (FIG. 8C) received within the central opening 410 and the closed end 332 of the detonator shell 330 is exposed. In this configuration, a pin connector (such as a first contact pin 512, described in further detail hereinbelow) of a bulkhead assembly 500 may contact the detonator shell 330 by extending through the central opening 410 of the body 401.

In an embodiment, at least a portion of the body 401 of the radial booster charge 400 extends from the closed end 332 of the detonator shell 330. The body 401 of the radial booster charge 400 and the detonator shell 330 may be a unitary/one-piece structure, with the body 401 extending from the detonator shell 330. According to an aspect, the detonator may include two open ends, with the radial booster charge 400 extending downwardly from the detonator shell 330 (FIG. 8B). It is contemplated that in this configuration, the body 401 of the radial booster charge 400 may function as a lineout portion 407. Alternatively, the body 401 may be formed of the same material as the detonator shell 330 and may be coupled to the detonator shell 330, such that the body 401 (or the lower end 406 of the body 401) functions as the lineout portion (FIG. 8C). The lineout portion 407 of the radial booster charge 400 or the lineout portion 331 of the detonator shell 330 may be in direct electrically conductive contact with a pin or other electrically conductive structure of the bulkhead assembly 500 (described in further detail hereinbelow).

According to an aspect and as illustrated in FIG. 6, the wireless, push-in detonator 300 may include an insulating layer 335. The insulating layer 335 may extend around at least a portion of the detonator shell 330. In an embodiment, the insulating layer 335 extends only around a portion of the detonator shell 330 leaving the closed end 332 of the detonator shell 330 uncovered. The insulating layer 335 may include an electrical insulating coating applied on the detonator shell 330. As would be understood by one of ordinary skill in the art, any insulating coating suitable for steel and other metals, may be used to coat a portion of the detonator shell 330.

Figure 9:
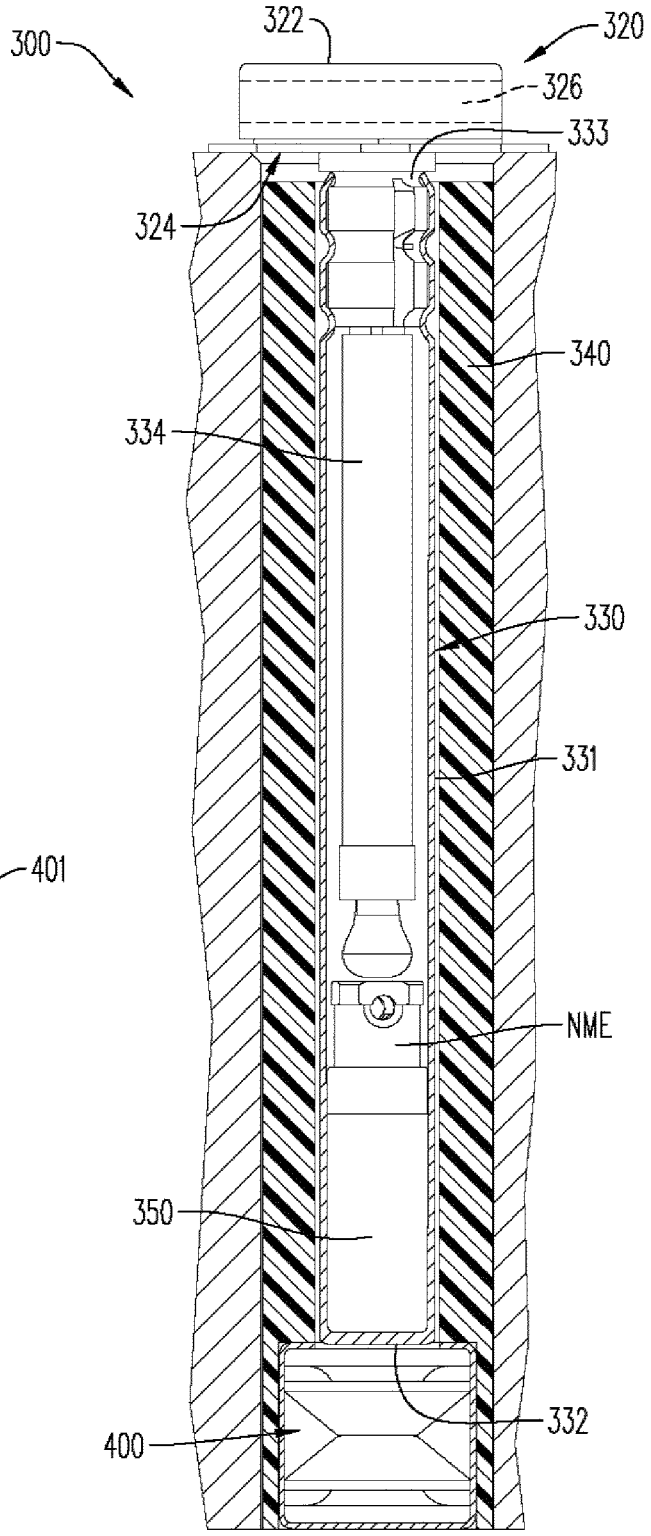
FIG. 9 illustrates a radial booster charge and a wireless, push-in detonator positioned in a sleeve, according to an embodiment.

As illustrated in, for example, FIG. 9, a sleeve/insulating sleeve/detonator sleeve 340 may at least partially enclose the wireless, push-in detonator 300 and, in some embodiments, may at least partially enclose the wireless, push-in detonator 300 and the radial booster charge 400. The sleeve 340 prevents the detonator shell 330 from being touching the surface of the chamber 126 or from otherwise being in contact with the material forming the housing 120. According to an aspect and as illustrated in FIGS. 10A-10C, 11 and 14, the sleeve 340 is disposed within the chamber 126 of the housing 120 and dimensionally extends around the detonator shell 330 and, in some embodiments, the detonator shell 330 and the radial booster charge 400. The sleeve 340 may include a non-conductive material. According to an aspect, the sleeve 340 is composed of at least one of an electrically non-conductive injection molded plastic, a machined non-conductive material and surface anodized aluminum.

FIG. 6, FIGS. 10A-12, FIG. 14 and FIG. 18, for example, illustrate the bulkhead assembly 500 in communication with the wireless, push-in detonator 300. The bulkhead assembly 500 is positioned in the chamber 126 of the housing 120. According to an aspect, the bulkhead assembly 500 is positioned in the third and fourth cavities 126*c*, 126*d* of the chamber 126. The bulkhead assembly 500 may include components, as described in detail hereinbelow, that are able to rotate/pivot about their own axis. The bulkhead assembly 500 may be configured substantially as described in U.S. Pat. No. 9,784,549, commonly-owned and assigned to DynaEnergetics GmbH & Co. KG, which is incorporated by reference herein in its entirety to the extent that it is consistent with this disclosure.

Figure 10A:
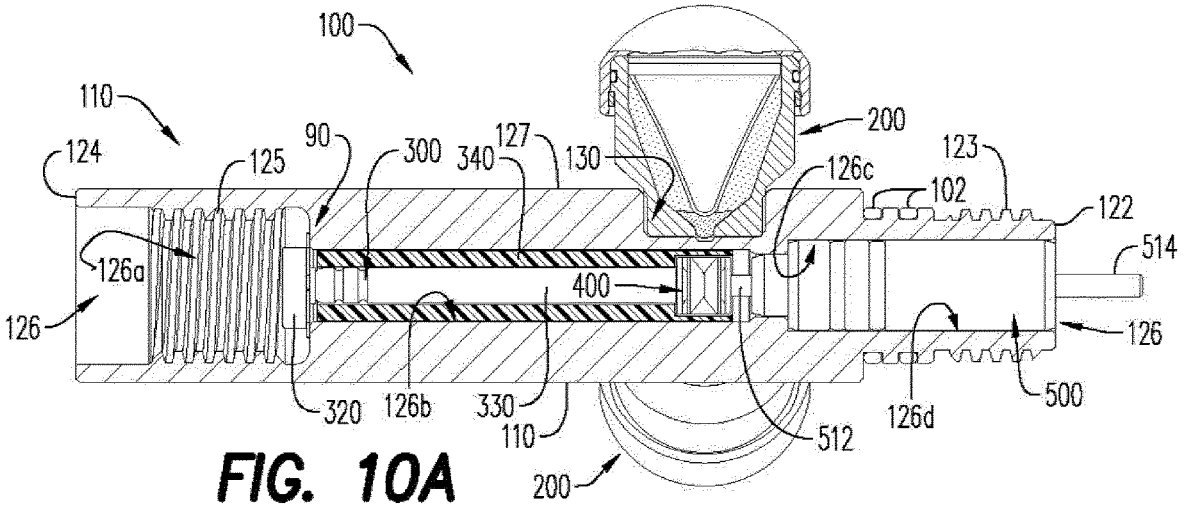
FIG. 10A is a side, partial cross-sectional view of an exposed perforating gun module, illustrating a wireless, push-in detonator, shaped charges and bulkhead assembly assembled in a housing of the perforating gun module, according to an embodiment.
Figure 10B:
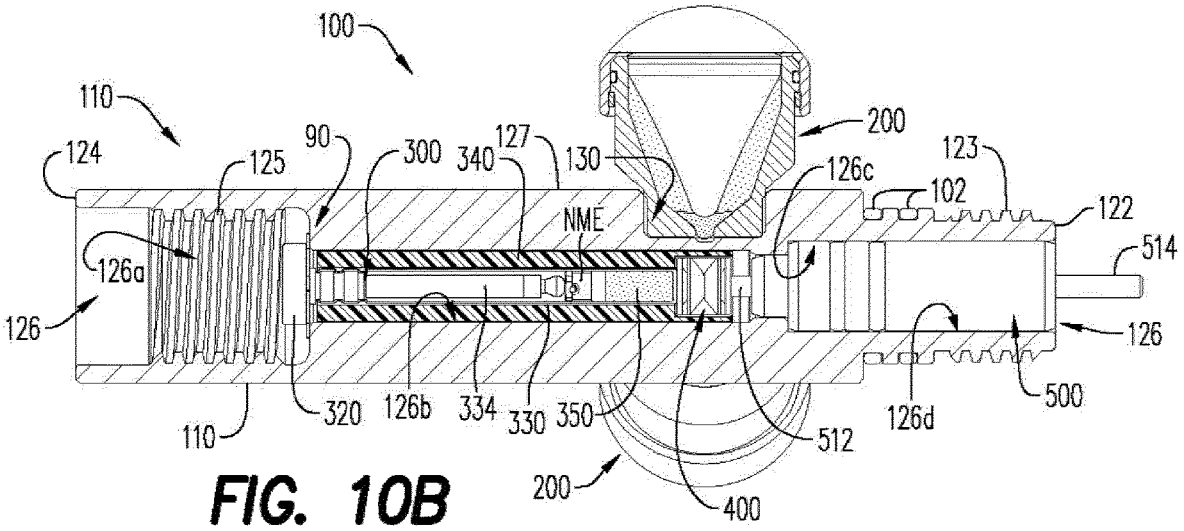
FIG. 10B is a side, partial cross-sectional view of the perforating gun module of FIG. 10A, illustrating contents of the wireless, push-in detonator of FIG. 9.
Figure 10C:
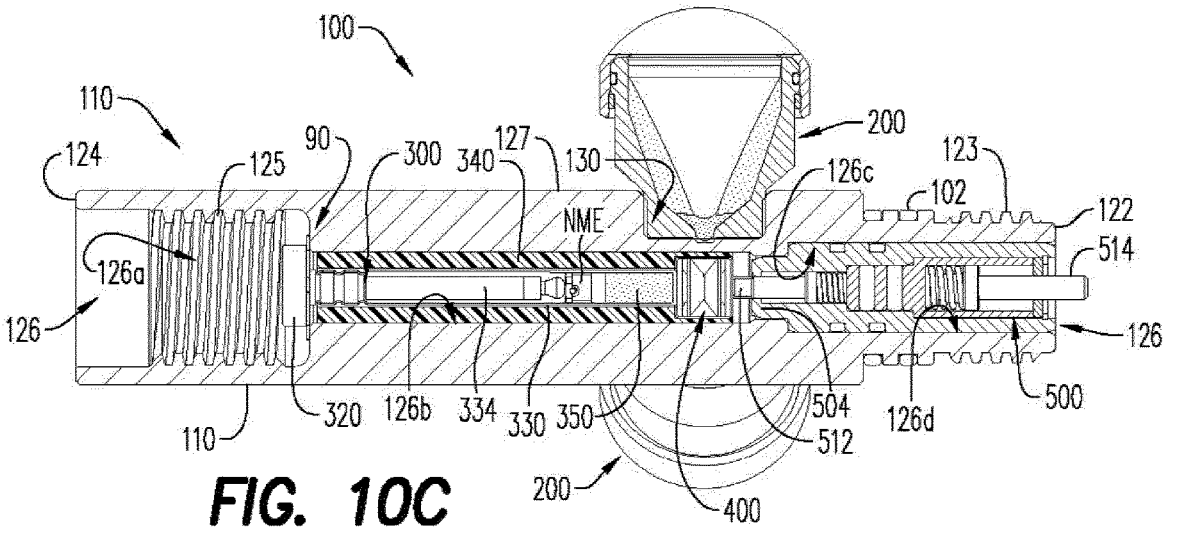
FIG. 10C is a side, partial cross-sectional view of an exposed perforating gun module, illustrating contents of the wireless, push-in detonator and bulkhead assembly of FIG. 6.

In an embodiment, the bulkhead assembly 500 includes a bulkhead body 502 having a first end 504 and a second end 506. An electrical contact component 501 extends through the bulkhead body 502, between the first and second ends 504, 506. The electrical contact component 501 may be configured to pivot about its own axis. According to an aspect, the electrical contact component 501 includes a first contact pin 512 extending from the first end 504, and a second contact pin 514 extending from the second end 506. As illustrated in FIGS. 6, 10C and 11, for example, the first and second contact pins 512, 514 may be spaced apart from each other by one or more biasing members or springs 503. According to an aspect the first contact pin 512 includes a metal contact that is in direct contact with the lineout portion 331 of the detonator shell 330, or in some embodiments the lineout portion 407 of the body 401 of the radial booster charge 400. In some embodiments, the first contact pin 512 is in direct contact with the lineout portion 331 of the detonator shell 330 by extending through the central opening 410 of the radial booster charge 400 and contacting the closed end of the detonator shell 330. In these exemplary configurations, there is no need for a separate wire, such as feed through wire, for relaying an electrical signal from the detonator 300 to the bulkhead 500. Instead, the first contact pin 512 provides electrical contact from the detonator 300 to the bulkhead assembly 500. The second contact pin 514 may include a metal contact. When multiple exposed perforating gun modules 110 are connected or assembled to each other, the second contact pin 514 transfers an electrical signal from the bulkhead assembly 500 to the line-in portion of a detonator of the adjacent/downhole facing exposed perforating gun module. While FIGS. 6, 10A-10C, 11 and 14 illustrated the first and second contact pins 512, 514 and their associated biasing members 503 having different sizes, each contact pin 512, 514 may be of the same size and each biasing member 503 may be of the same size. The first contact pin 512 may be dimensioned to extend through the opening 410 formed in the body 401 of the radial booster charge 400, which may, in some embodiments, requires a smaller sized pin than the second contact pin 514.

Figure 10D:
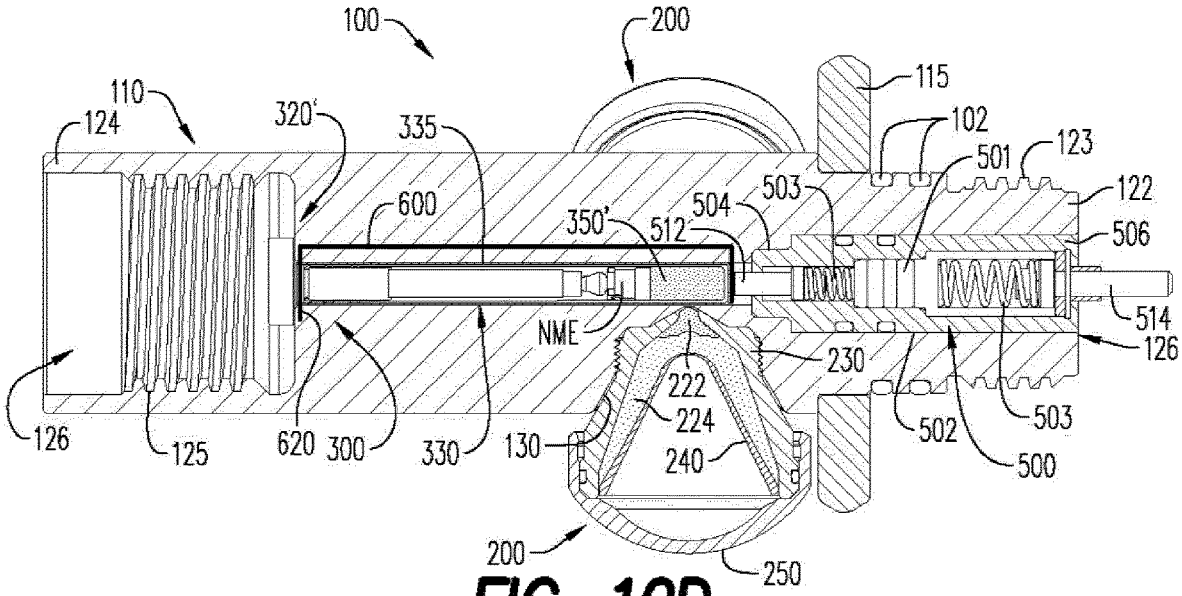
FIG. 10D is a side, partial cross-sectional view of an exposed perforating gun module including a through wire, according to an embodiment.
Figure 10E:
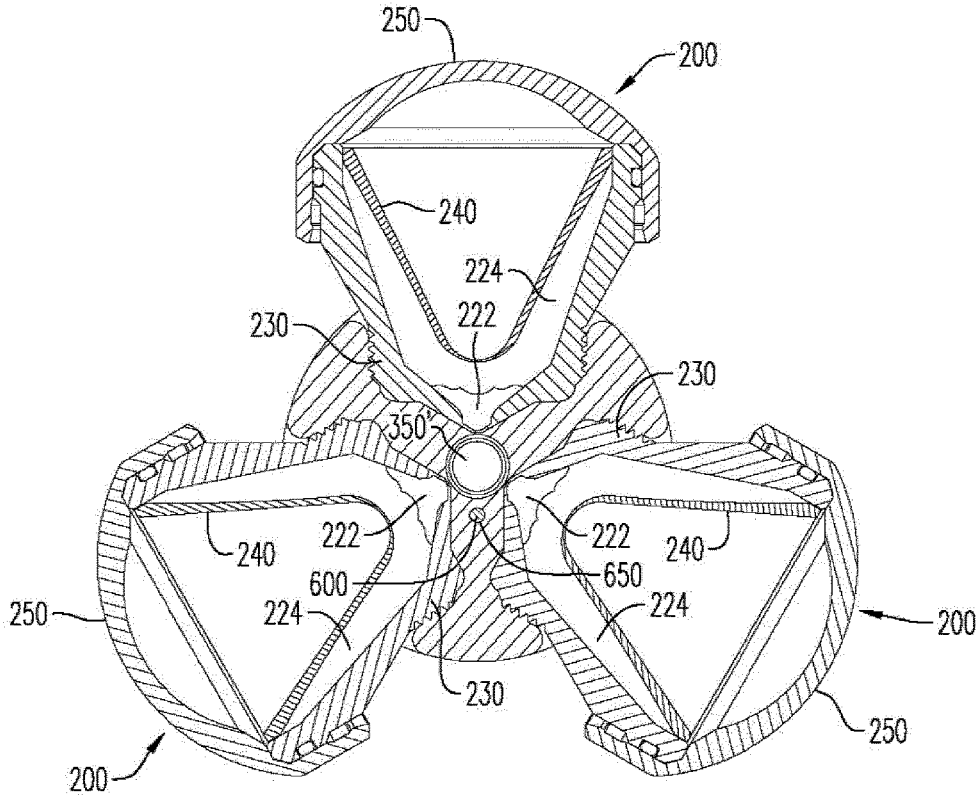
FIG. 10E is a cross-sectional view of the perforating gun module of FIG. 10D, illustrating the through wire secured in a through hole.

As illustrated in FIG. 10D and FIG. 10E, it is also contemplated for some embodiments, that the perforating gun assembly 100 may include a wireless detonator 300' configured substantially as described in U.S. Pat. Nos. 9,605,937 and 9,581,422, commonly-owned and assigned to DynaEnergetics GmbH & Co. KG, which is incorporated by reference herein in its entirety to the extent that it is consistent with this disclosure. In this configuration, the detonator head 320' of the detonator includes a line-in portion, a lineout portion and an insulating portion extending between the line-in and lineout portions, while the detonator body 330' includes the explosive load 350' and is configured as the ground. It is contemplated that there may be a gap respectively between the detonator 300 or the body 401 of the radial booster charge 400 and the first contact pin 512 of the bulkhead assembly 500. In such a configuration, the exposed perforating gun module 110 may include a through wire/feed through wire 600 that extends from the lineout portion of the detonator 300' to the first contact pin 512 of the bulkhead assembly. The through wire 600 may include a contact ring 620 that enables the through wire 600 to be secured to the detonator 300'. As illustrated in FIG. 10E, the through wire 600 may be extend in a through hole 650. The through hole 650 may be formed along at least a portion of the length of the perforating gun module, between the second end 124 and the third cavity 126*c* of the chamber 126 of the perforating gun module 110. The through wire 600 may be isolated from pressures or fluids in the wellbore, by virtue of being disposed in the through hole 650. The through wire 600 may be disposed in the gap between the detonator shell 330' and the first contact pin 512. The metal contact of the first contact pin 512 secures the feed through wire 600 to the first end of the bulkhead assembly 500 and provides electrical contact through the bulkhead assembly 500 to the second downhole facing pin 514. As described hereinabove, the downhole facing pin 514 transfers an electrical signal from the bulkhead assembly 500 to a detonator of the adjacent/downhole facing exposed perforating gun module.

FIGS. 15A-15B and FIGS. 16, 17 and 18 illustrate a plurality of perforating gun assemblies 100, including a string or train of exposed perforating gun modules 110 threadingly secured to each other. Each perforating gun assembly 100 in the string is configured substantially as described hereinabove, thus for purpose of convenience and not limitation, those features are not described hereinbelow.

The shaped charges 200 in each perforating gun assembly 100 may be arranged in a first single axial plane, while the shaped charges in consecutive perforating gun assemblies are respectively arranged in second, third, fourth, etc. axial planes and extend radially from the central axis Y of the housing of each respective exposed perforating gun module 110. The shaped charges in the consecutive perforating guns are in an outward, radial arrangement, such that the perforating jets created by the shaped charges in the second, third, fourth, etc. axial planes fire in a direction away from the chambers of each housing.

As described hereinabove, the sockets 130 in each perforating gun assembly 100, and thus the shaped charges 200 secured in the sockets 130, may be arranged to facilitate any industry phasing. According to an aspect, the sockets 130 in a single housing 120 may extend in a single line (i.e., inline). When two or more exposed perforating gun modules 110 are secured together, the sockets 130 of all the exposed perforating gun modules 110 may also be in a single line/plane. According to an aspect, the sockets 130 of each exposed perforating gun module 110 may be staggered or oriented at 30°, 60°, 120°, 180°, and the like, phasing away from the sockets in an adjacent exposed perforating gun module. It is also contemplated that the sockets 130 may be in a spiral arrangement/spiral-phased around the length L of the exposed perforating gun module.

When the exposed perforating gun modules 110 are secured together, the electrical ground 90 of a downstream (i.e., further into the wellbore) perforating gun assembly 100 may engage a first connector end 122 of a housing 120 of a connected, upstream perforating gun assembly. This provides a secure and reliable electrical ground contact from the detonator 300 to the upstream perforating gun assembly. The electrical ground 90 is further secured in its designated exposed perforating gun module by virtue of the first connector end 122 of the upstream perforating gun assembly being secured within the second connector end 124 of the downstream perforating gun assembly.

In some embodiments and as illustrated in FIGS. 5-6, FIGS. 13-14 and FIG. 16, each exposed perforating gun module 110 may include a shield/blast absorber 115. The shield 115 may help pump the exposed perforating gun module 100 or a string of exposed perforating gun modules 100 down a wellbore. Upon detonation of a set of encapsulated shaped charges secured to the exposed perforating gun module, the shield 115 may help to protect the encapsulated shaped charges of other exposed perforating gun modules in the gun string from being damaged by shrapnel or other debris generated from the detonation of the set of charges. The shield 115 may be circumferentially positioned on the housing 120 of an exposed perforating gun module 110. According to an aspect, the shield 115 includes an opening 115*a* dimensioned to fit around the first connector end 122 of the housing 120. According to an aspect, the opening 115*a* may be a circular opening that circumferentially extends around the first connector end 122. The shield 115 may have a minimum diameter for receiving the first connector end 122 of the housing 120 and being secured thereto. The shield 115 may be formed of any material that is mechanically robust to facilitate deployment and retrieval of the exposed perforating gun module 110 including the shield 115 from the wellbore. In an embodiment, the shield 115 extends beyond the closure members 250 of the shaped charges 200 secured in the exposed perforating gun module 110. This can help to protect the shaped charges when the gun module 110 is being run in the wellbore and further facilitate the ease in which perforating gun module 110 or strings of exposed perforating gun modules 110 is run in the well. The shield 115 is configured to withstand continuous exposure to wellbore temperatures, impact, and exposure to fluids within the wellbore. According to an aspect, the shield 115 is formed from at least one of cast-iron, steel, aluminum, zinc and any mechanically robust injection molded material. The shield 115 may include plastics that are strong enough to withstand high temperatures in the wellbore, and mechanical impact. According to an aspect, the shield 115 includes polyamide.

Figure 20:
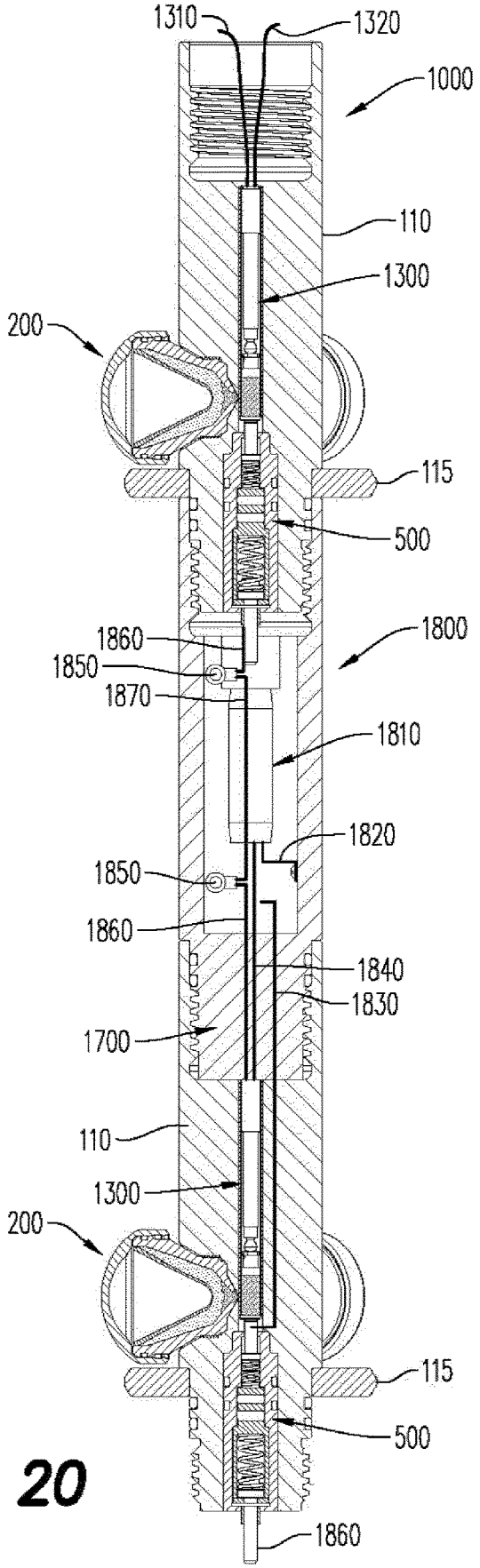
FIG. 20 is a cross-sectional view of a pressure tight connector connected to exposed perforating gun modules that each include a wired detonator, illustrating the wired detonator being connected to a selective electronic switch circuitry housed in the pressure tight connector, according to an aspect.

As would be understood by one of ordinary skill in the art, the perforating gun assemblies or perforating gun modules described herein may be used with wired detonators or igniters. FIG. 20 illustrates a perforating gun assembly 1000 including a string of perforating gun modules 110, whereby each gun module 110 includes a wired detonator 1300. The exposed perforating gun module 110 may be configured substantially as described hereinabove and as illustrated in, for example, FIG. 1, FIGS. 2A-2B, FIGS. 5-7, FIGS. 10A-10E and FIG. 11. Thus, for purpose of convenience, and not limitation, the features and characteristics of the exposed perforating gun module 110 are not repeated here.

The perforating gun assembly 1000 is an exposed perforating gun system with a pressure tight (non-exposed) central support structure (i.e., the exposed perforating gun module 110). As illustrated in FIG. 20, the exposed perforating gun modules 110 may be connected to each other via a pressure tight connector or sub assembly 1700. The housing 120 of the exposed perforating gun module 110, in combination with the pressure tight connector 1700 is fully retrievable from the wellbore. As illustrated in FIG. 20, the perforating gun module 110 mechanically secures the encapsulated shaped charges 200. It is contemplated that the charges 200 may be secured in all industry standard or other desired configurations and phasings, including, but not limited to three charges in a single plane (radially or circumferentially about the housing 120 in a single plane, along a length of the housing 120 in a single plane, and the like), and a plurality of charges arranged in a spiral along the length of the housing 120.

The exposed perforating gun module 110 and the pressure tight connector 1700 houses the initiation and ballistic transfer components. In an embodiment, the perforating gun module 110 houses the wired detonator 1300. The wired detonator 1300 includes a signal-in/line-in wire 1320, a signal-out/lineout wire (not shown) and a ground wire 1320. In this configuration, a wiring arrangement 1800 is disposed in the pressure tight connector 1700. The wiring arrangement 1800 may include a switch ground 1820, a switch line-in 1870, a switch through wire 1830, a detonator ground 1840 and a detonator hot wire/line-in connection 1860 from the detonator. The wires of the wiring arrangement 1800 are matched to the wires of the wired detonator 1300, and an inner metallic portion of one wire is twisted together with an inner metallic portion of the matched wire using an electrical connector cap or wire nut or a scotch-lock type connector 1850.

An integrated selective electronic switch circuitry 1810 is included in the pressure tight connector 1700. As used herein, the term "selective electronic switch circuitry" refers to a solid state electronic switch circuitry which may be addressed from an inactivated state, to an activated state by the action of an operator at a remote location, and desirably by an action in which the switch circuitry is addressed via a specific electronic, digital, or wavelength-type control signal. The wiring arrangement 1800 extends from the switch circuitry 1810 to either grounding locations, other connections, or the wired detonator 1300. According to an aspect, the wiring arrangement 1800 may include an additional cable that connects with grounding devices/structures, such as a ground screw. As seen in FIG. 20, the wiring arrangement 1800 may pass from the selective electronic switch circuitry 1810 to the detonator 1300 contained in the perforating gun module 110.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A perforating gun assembly comprising:

a perforating gun module comprising:

a housing including:

an outer surface, a first connector end, a second connector end opposite the first connector end and spaced apart from the first connector end, and a chamber extending along a central axis of the housing between the first connector end and the second connector end;

a plurality of sockets extending into the outer surface of the housing towards the chamber, wherein the sockets are arranged around the central axis of the housing, each socket of the plurality of sockets being configured to receive a shaped charge, and each socket comprising a connector comprising at least one of an internal thread, a bayonet mount, or a retainer lock, the connector being configured to secure the corresponding shaped charge in the socket; and a sealing member disposed at at least one of the first connector end, the second connector end, or the plurality of sockets such that the chamber of the housing is pressure sealed, wherein the chamber of the housing includes:

a first cavity configured for receiving a first connector end of an adjacent perforating gun module;

a second cavity configured for receiving an initiator; and a third cavity configured for receiving at least a portion of a bulkhead assembly.

2. The perforating gun assembly of claim 1, wherein the housing further comprises:

a first thread provided at the first connector end; and a second thread provided at the second connector end, the second thread extending at least partially into the chamber.

3. The perforating gun assembly of claim 1, further comprising a shield circumferentially positioned on the outer surface of the housing.

4. The perforating gun assembly of claim 1, wherein each socket is configured as one of a depression or an opening formed in the housing.

5. The perforating gun assembly of claim 1, wherein the connector is the internal thread, and each shaped charge comprises a back wall protrusion comprising an external thread configured to couple to the internal thread of the socket.

6. The perforating gun assembly of claim 1, further comprising:

a wireless detonator positioned within the chamber; and a radial booster charge positioned within the chamber adjacent the detonator and each socket, wherein the detonator is configured to initiate the radial booster charge in response to an initiating signal, and the radial booster charge is configured to produce a radial explosive force that initiates the shaped charges.

7. The perforating gun assembly of claim 6, wherein the detonator comprises:

a detonator shell including a lineout portion, a detonator head including a line-in portion, and a ground portion spaced apart from the line-in portion by an insulator, wherein the detonator shell or a housing of the radial booster charge contacts a pin of the bulkhead assembly.

8. The perforating gun assembly of claim 1, wherein the shaped charges are encapsulated shaped charges comprising:

a case comprising a cavity, a closed end, and an open end opposite the closed end and spaced apart from the closed end;

an explosive load in the cavity;

a liner adjacent the explosive load; and a closure member configured to close the open end.

9. The perforating gun assembly of claim 1, wherein the shaped charges comprises a zinc alloy, and is configured to form a pulverized material upon detonation of the shaped charges.

10. A wireless detonator for use with a perforating gun assembly, the detonator comprising:

a detonator head comprising a line-in portion, a ground portion, and an insulator extending between the line-in portion and the ground portion; and a detonator shell, wherein the detonator shell is a lineout portion in communication with the line-in portion, wherein the detonator is configured to initiate in response to an initiating signal.

11. The detonator of claim 10, further comprising:

an electronic circuit board housed within the detonator shell.

12. The detonator of claim 10, wherein the detonator shell comprises an open end portion and a closed end portion, and the detonator further comprises a radial booster charge coupled to the closed end portion.

13. The detonator of claim 12, wherein the radial booster charge comprises:

a body having a first end, a second end, and an opening extending from the first end to the second end, wherein the opening is sized for receiving at least a portion of the detonator shell such that the radial booster charge surrounds the portion of the detonator shell received within the central opening.

14. The detonator of claim 13, wherein the booster charge comprises:

an explosive extending around a central axis of the body; and a liner extending around the explosive.

15. The detonator of claim 12, further comprising:

a main explosive load within the detonator shell, the main explosive load positioned at the closed end portion of the shell in a spaced apart configuration from the electronic circuit board.

16. The detonator of claim 12, wherein the radial booster charge is configured to be initiated in response to initiation of the detonator, and the radial booster charge is configured to produce a radial explosive force.

* * * * *